US011102604B2

(12) United States Patent
Eronen et al.

(10) Patent No.: US 11,102,604 B2
(45) Date of Patent: Aug. 24, 2021

(54) APPARATUS, METHOD, COMPUTER PROGRAM OR SYSTEM FOR USE IN RENDERING AUDIO

(71) Applicant: Nokia Technologies Oy, Espoo (FI)

(72) Inventors: Antti Johannes Eronen, Tampere (FI); Mikko-Ville Ilari Laitinen, Espoo (FI); Arto Juhani Lehtiniemi, Lempaala (FI); Miikka Tapani Vilermo, Siuro (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/878,721

(22) Filed: May 20, 2020

(65) Prior Publication Data

US 2020/0382896 A1 Dec. 3, 2020

(30) Foreign Application Priority Data

May 31, 2019 (EP) ..... 19177612

(51) Int. Cl.
*H04S 7/00* (2006.01)

(52) U.S. Cl.
CPC ..... *H04S 7/304* (2013.01); *H04S 2400/01* (2013.01)

(58) Field of Classification Search
CPC .... G06F 3/165; G06F 3/167; G06F 17/30061; G06F 3/011; G06F 3/04815; G06F 2217/82; G06T 19/006; G06T 15/205; G06K 9/00671; H04S 7/302; H04S 7/303; H04S 3/008; H04S 2400/01;
(Continued)

(56) References Cited

U.S. PATENT DOCUMENTS

| | | | |
|---|---|---|---|
| 9,258,664 | B2 | 2/2016 | Kraemer |
| 9,560,467 | B2 | 1/2017 | Gorzel et al. |
| 10,038,967 | B2 | 7/2018 | Jot et al. |

(Continued)

FOREIGN PATENT DOCUMENTS

| | | | |
|---|---|---|---|
| CN | 1860826 | A | 11/2006 |
| CN | 106954139 | A | 7/2017 |

OTHER PUBLICATIONS

GB Application No. 1818690.8, "Audio Processing", filed on Nov. 16, 2018, 55 pages.

(Continued)

*Primary Examiner* — Norman Yu
(74) *Attorney, Agent, or Firm* — Harrington & Smith

(57) ABSTRACT

An apparatus, a method and a computer program product are provided for use in rendering audio. An apparatus is configured for: receiving a first audio signal representative of a virtual sound scene, wherein the first audio signal is configured for rendering on an arrangement of loudspeakers to a user; determine a first portion of the virtual sound scene to be rendered on headphones of the user; generating a second audio signal representative of the first portion of the virtual sound scene; determining a second portion of the virtual sound scene to be rendered on the arrangement of loudspeakers; generating a third audio signal, representative of the second portion of the virtual sound scene; and wherein the second and third audio signals are generated such that, when rendered, an augmented version of the virtual sound scene is rendered to the user.

20 Claims, 9 Drawing Sheets

(58) Field of Classification Search
CPC ..... H04S 2400/11; H04R 1/403; H04R 3/12; H04R 5/02; H04R 5/04
USPC ..... 381/17, 310, 56, 61, 104, 107, 303; 345/419, 633; 700/94; 463/31
See application file for complete search history.

(56) References Cited

U.S. PATENT DOCUMENTS

| | | | | |
|---|---|---|---|---|
| 2015/0358715 | A1* | 12/2015 | Macours | H04R 5/04 381/74 |
| 2017/0223478 | A1* | 8/2017 | Jot | G10L 19/00 |
| 2017/0359467 | A1* | 12/2017 | Norris | G06F 3/165 |
| 2019/0116450 | A1* | 4/2019 | Tsingos | H04S 7/307 |

OTHER PUBLICATIONS

Harma et al., "Augmented Reality Audio for Mobile and Wearable Appliances", Journal of the Audio Engineering Society, vol. 52, No. 6, 2004, pp. 618-639.
Floros et al., "Spatial Enhancement for Immersive Stereo Audio Applications", 17th International Conference on Digital Signal Processing (DSP), Jul. 6-8, 2011, 7 pages.
Basha et al., "Stereo Widening System Using Binaural Cues for Headphones", International Conference on Signal Processing and Communication Systems, Dec. 2007, 5 pages.
Extended European Search Report received for corresponding European Patent Application No. 19177612.9, dated Oct. 29, 2019, 9 pages.
Paavola et al., "3D Audio for Mobile Devices via Java", Audio Engineering Society, May 28-31, 2005, 20 pages.

* cited by examiner

APPARATUS, METHOD, COMPUTER PROGRAM OR SYSTEM FOR USE IN RENDERING AUDIO

TECHNOLOGICAL FIELD

Examples of the present disclosure relate to apparatuses, methods, computer programs or systems for use in rendering audio. Some examples, though without prejudice to the foregoing, relate to apparatuses, methods, computer programs or systems for enhancing the rendering of spatial audio from an arrangement of loudspeakers.

BACKGROUND

The conventional rendering of audio, such as spatial audio, from an arrangement of loudspeakers (e.g. a multi-channel loudspeaker set-up such as a pair of stereo loudspeakers, or a surround sound arrangement of loudspeakers) is not always optimal.

It is useful to provide an apparatus, method, computer program and system for improved rendering of audio.

The listing or discussion of any prior-published document or any background in this specification should not necessarily be taken as an acknowledgement that the document or background is part of the state of the art or is common general knowledge. One or more aspects/examples of the present disclosure may or may not address one or more of the background issues.

BRIEF SUMMARY

The scope of protection sought for various embodiments of the invention is set out by the independent claims. The examples and features, described in this specification that do not fall under the scope of the independent claims are to be interpreted as examples useful for understanding various embodiments of the invention.

According to various, but not necessarily all, examples of the disclosure there is provided an apparatus comprising means configured for:

receiving a first audio signal representative of a virtual sound scene, wherein the first audio signal is configured for rendering on an arrangement of loudspeakers such that, when rendered on the arrangement of loudspeakers, the virtual sound scene is rendered to a user;

determining a first portion of the virtual sound scene to be rendered on headphones of the user;

generating a second audio signal representative of the first portion of the virtual sound scene, wherein the second audio signal is configured for rendering on the headphones;

determining a second portion of the virtual sound scene to be rendered on the arrangement of loudspeakers;

generating a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

According to various, but not necessarily all, examples of the disclosure there is provided a method comprising:

receiving a first audio signal representative of a virtual sound scene, wherein the first audio signal is configured for rendering on an arrangement of loudspeakers such that, when rendered on the arrangement of loudspeakers, the virtual sound scene is rendered to a user;

determining a first portion of the virtual sound scene to be rendered on headphones of the user;

generating a second audio signal representative of the first portion of the virtual sound scene, wherein the second audio signal is configured for rendering on the headphones;

determining a second portion of the virtual sound scene to be rendered on the arrangement of loudspeakers;

generating a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

According to various, but not necessarily all, examples of the disclosure there is provided a chipset comprising processing circuitry configured to perform the above-mentioned method.

According to various, but not necessarily all, examples of the disclosure there is provided a module, device and/or system comprising means for performing the above-mentioned method.

According to various, but not necessarily all, examples of the disclosure there is provided computer program instructions for causing an apparatus to perform:

receiving a first audio signal representative of a virtual sound scene, wherein the first audio signal is configured for rendering on an arrangement of loudspeakers such that, when rendered on the arrangement of loudspeakers, the virtual sound scene is rendered to a user;

determining a first portion of the virtual sound scene to be rendered on headphones of the user;

generating a second audio signal representative of the first portion of the virtual sound scene, wherein the second audio signal is configured for rendering on the headphones;

determining a second portion of the virtual sound scene to be rendered on the arrangement of loudspeakers;

generating a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

According to various, but not necessarily all, examples of the disclosure there is provided an apparatus comprising:

at least one processor; and at least one memory including computer program code;

the at least one memory and the computer program code configured to, with the at least one processor, cause the apparatus at least to perform:

receiving a first audio signal representative of a virtual sound scene, wherein the first audio signal is configured for rendering on an arrangement of loudspeakers such that, when rendered on the arrangement of loudspeakers, the virtual sound scene is rendered to a user;

determining a first portion of the virtual sound scene to be rendered on headphones of the user;

generating a second audio signal representative of the first portion of the virtual sound scene, wherein the second audio signal is configured for rendering on the headphones;

determining a second portion of the virtual sound scene to be rendered on the arrangement of loudspeakers;

generating a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

According to various, but not necessarily all, examples of the disclosure there is provided a non-transitory computer readable medium comprising program instructions for causing an apparatus to perform:

receiving a first audio signal representative of a virtual sound scene, wherein the first audio signal is configured for rendering on an arrangement of loudspeakers such that, when rendered on the arrangement of loudspeakers, the virtual sound scene is rendered to a user;

determining a first portion of the virtual sound scene to be rendered on headphones of the user;

generating a second audio signal representative of the first portion of the virtual sound scene, wherein the second audio signal is configured for rendering on the headphones;

determining a second portion of the virtual sound scene to be rendered on the arrangement of loudspeakers;

generating a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

According to various, but not necessarily all, examples of the disclosure there are provided examples as claimed in the appended claims.

The following portion of this 'Brief Summary' section describes various features that can be features of any of the embodiments described in the foregoing portion of the 'Brief Summary' section. The description of a function should additionally be considered to also disclose any means suitable for performing that function.

In some but not necessarily all examples, the virtual sound scene comprises a first virtual sound object having a first virtual position, wherein the determined first portion comprises the first virtual sound object, and wherein the apparatus is configured to:

generate the second audio signal so as to control the virtual position of the first virtual sound object of the first portion of the virtual sound scene represented by the second audio signal such that, when the second audio signal is rendered on the headphones, the first virtual sound object is rendered to the user at a second virtual position.

In some but not necessarily all examples, the second audio signal is generated such that, when rendered on the headphones, a modified version of the first portion is rendered to the user.

In some but not necessarily all examples, the second virtual position is different to the first virtual position.

In some but not necessarily all examples, said determining the first portion of the virtual sound scene to be rendered on the headphones comprises determining one or more virtual sound objects to be stereo widened.

In some but not necessarily all examples, said determining the first portion of the virtual sound scene to be rendered on the headphones comprises determining one or more virtual sound objects whose virtual distance is less than a threshold virtual distance.

In some but not necessarily all examples, the second virtual position is substantially the same as the first virtual position.

In some but not necessarily all examples, the apparatus is configured to generate the second and third audio signals such that, when the second and third signals are simultaneously rendered on the headphones and the arrangement of loudspeakers respectively, they are perceived by the user to be in temporal synchronisation.

In some but not necessarily all examples, the apparatus comprises means configured to cause:

the second audio signal to be conveyed to the headphones for rendering therefrom; and the third audio signal to be conveyed to arrangement of loudspeakers for rendering therefrom.

In some but not necessarily all examples, the apparatus is configured to transform the second audio signal for spatial audio rendering on the headphones.

In some but not necessarily all examples, the position of the headphones is tracked and the generating and/or rendering of the second audio signal is modified based on the tracked position.

In some but not necessarily all examples, one or more of the audio signals is: a spatial audio signal and/or a multichannel audio signal.

BRIEF DESCRIPTION OF THE DRAWINGS

For a better understanding of various examples of the present disclosure that are useful for understanding the detailed description and certain embodiments of the invention, reference will now be made by way of example only to the accompanying drawings in which.

Figure 1A:
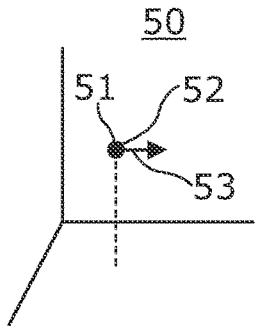
FIGS. 1A and 1B schematically illustrate an example real space for use with examples of the subject matter described herein.

The Figures are not necessarily to scale. Certain features and views of the figures can be shown schematically or exaggerated in scale in the interest of clarity and conciseness. For example, the dimensions of some elements in the figures can be exaggerated relative to other elements to aid explication. Similar reference numerals are used in the figures to designate similar features. For clarity, all reference numerals are not necessarily displayed in all figures.

Definitions

"artificial environment" may be something that has been recorded or generated.

"virtual space" may mean: a virtual sound space, a virtual visual space or a combination of a virtual visual space and corresponding virtual sound space. In some examples, the virtual space may extend horizontally up to 360° and may extend vertically up to 180°.

"virtual scene" may mean: a virtual sound scene, a virtual visual scene, or a combination of a virtual visual scene and corresponding virtual sound scene.

"virtual object" is an object within a virtual scene. It may be an augmented virtual object (e.g. a computer-generated virtual object). It may be a virtual sound object and/or a virtual visual object. It may be an aural rendering or a visual rendering (e.g. image) of a real object in a real space that is live or recorded.

"virtual position" is a position within a virtual space. It may be defined using a virtual location and/or a virtual orientation. It may be considered to be a movable 'point-of-view' in virtual visual space and/or virtual sound space.

"virtual sound space"/"virtual audio space" refers to a fully or partially artificial environment that may be listened to, which may be three-dimensional. The virtual sound space may comprise an arrangement of virtual sound objects in a three-dimensional virtual sound space.

"virtual sound scene"/"virtual audio scene" refers to a representation of the virtual sound space listened to from a particular point-of-view (e.g. position comprising a location and orientation) within the virtual sound space. The virtual sound scene may comprise an arrangement of virtual sound objects in a three-dimensional space.

"virtual sound object" is an audible virtual object within a virtual sound space or a virtual sound scene.

"virtual visual space" refers to a fully or partially artificial environment that may be viewed, which may be three-dimensional.

"virtual visual scene" refers to a representation of the virtual visual space viewed from a particular point-of-view (e.g. position comprising a location and orientation) within the virtual visual space.

"virtual visual object" is a visible virtual object within a virtual visual scene.

"correspondence" or "corresponding" when used in relation to a virtual sound space and a virtual visual space means that the virtual sound space and virtual visual space are time and space aligned, that is they are the same space at the same time.

"correspondence" or "corresponding" when used in relation to a virtual sound scene and a virtual visual scene (or visual scene) means that the virtual sound space and virtual visual space (or visual scene) are corresponding and a notional (virtual) listener whose point-of-view defines the virtual sound scene and a notional (virtual) viewer whose point-of-view defines the virtual visual scene (or visual scene) are at the same location and orientation, that is they have the same point-of-view (same virtual position, i.e. same location and orientation).

"sound space" refers to an arrangement of sound sources in a three-dimensional space. A sound space may be defined in relation to recording sounds (a recorded sound space) and in relation to rendering sounds (a rendered sound space).

"sound scene" refers to a representation of the sound space listened to from a particular point-of-view (position) within the sound space.

"sound object" refers to a sound source that may be located within a sound space. A source sound object represents a sound source within the sound space, in contrast to a sound source associated with an object in the virtual visual space. A recorded sound object represents sounds recorded at a particular microphone or location. A rendered sound object represents sounds rendered from a particular location.

"real space" (or "physical space") refers to a real environment, outside of the virtual space, which may be three-dimensional.

"real scene" refers to a representation of the real space from a particular point-of-view (position) within the real space.

"real visual scene" refers to a visual representation of the real space viewed from a particular real point-of-view (position) within the real space.

"mediated reality", refers to a user experiencing, for example visually and/or aurally, a fully or partially artificial environment (a virtual space) as a virtual scene at least partially rendered by an apparatus to a user. The virtual scene is determined by a point-of-view (virtual position) within the virtual space. Rendering or displaying the virtual scene means providing a virtual visual scene and/or a virtual sound scene in a form that can be perceived by the user.

"augmented reality" refers to a form of mediated reality in which a user experiences a partially artificial environment (a virtual space) as a virtual scene comprising a real scene, for example a real visual scene and real sound scene, of a physical real environment (real space) supplemented by one or more visual or audio elements rendered by an apparatus to a user. The term augmented reality implies a mixed reality or hybrid reality and does not necessarily imply the degree of virtuality (vs reality) or the degree of mediality. Augmented reality (AR) can generally be understood as providing a user with additional information or artificially generated items or content that is at least significantly overlaid upon the user's current real-world environment stimuli. In some such cases, the augmented content may at least partly replace a real-world content for the user. Additional information or content will usually be visual and/or audible. Similarly to VR, but potentially in more applications and use cases, AR may have visual-only or audio-only presentation. For example, user may move about a city and receive audio guidance relating to, e.g., navigation, location-based advertisements, and any other location-based information. Mixed reality (MR) is often considered as a more advanced form of AR where at least some virtual elements are inserted into the physical scene such that they provide the illusion that these elements are part of the real scene and behave accordingly. For audio content, or indeed audio-only use cases, many applications of AR and MR may appear difficult for the user to tell from one another. However, the difference is not only for visual content but it may be relevant also for audio. For example, MR audio rendering may take into account a local room reverberation, e.g., while AR audio rendering may not.

"virtual reality" refers to a form of mediated reality in which a user experiences a fully artificial environment (a virtual visual space and/or virtual sound space) as a virtual scene rendered by an apparatus to a user. Virtual reality (VR) can generally be understood as a rendered version of a visual and audio scene. The rendering is typically designed to closely mimic the visual and audio sensory stimuli of the real world in order to provide a user a natural experience that is at least significantly consistent with their movement within a virtual scene according to the limits defined by the content and/or application. VR in most cases, but not necessarily all cases, requires a user to wear a head mounted display (HMD), to completely replace the user's field of view with a simulated visual presentation, and to wear headphones, to provide the user the simulated audio content similarly completely replacing the sound scene of the physical space. Some form of head tracking and general motion tracking of the user consuming VR content is typically also necessary. This allows the simulated visual and audio presentation to be updated in order to ensure that, from the user's perspective, various scene components such as items and sound sources remain consistent with the user's movements. Additional means to interact with the virtual reality simulation, such as controls or other user interfaces (UI) may be provided but are not strictly necessary for providing the experience. VR can in some use cases be visual-only or audio-only virtual reality. For example, an audio-only VR experience may relate to a new type of music listening or any other audio experience.

"extended reality (XR)" is a term that refers to all real-and-virtual combined realities/environments and human-machine interactions generated by digital technology and various wearables. It includes representative forms such as augmented reality (AR), augmented virtuality (AV), mixed reality (MR), and virtual reality (VR) and any relevant interpolations.

"virtual content" is content, additional to real content from a real scene, if any, that enables mediated reality by, for example, providing one or more augmented virtual objects.

"mediated reality content" is virtual content which enables a user to experience, for example visually and/or aurally, a fully or partially artificial environment (a virtual space) as a virtual scene. Mediated reality content could include interactive content such as a video game or non-interactive content such as motion video.

"augmented reality content" is a form of mediated reality content which enables a user to experience, for example visually and/or aurally, a partially artificial environment (a virtual space) as a virtual scene. Augmented reality content could include interactive content such as a video game or non-interactive content such as motion video.

"virtual reality content" is a form of mediated reality content which enables a user to experience, for example visually and/or aurally, a fully artificial environment (a virtual space) as a virtual scene. Virtual reality content could include interactive content such as a video game or non-interactive content such as motion video.

"perspective-mediated" as applied to mediated reality, augmented reality or virtual reality means that user actions determine the point-of-view (virtual position) within the virtual space, changing the virtual scene.

"first person perspective-mediated" as applied to mediated reality, augmented reality or virtual reality means perspective-mediated with the additional constraint that the user's real point-of-view (location and/or orientation) determines the point-of-view (virtual position) within the virtual space of a virtual user.

"third person perspective-mediated" as applied to mediated reality, augmented reality or virtual reality means perspective-mediated with the additional constraint that the user's real point-of-view does not determine the point-of-view (virtual position) within the virtual space.

"user interactive" as applied to mediated reality, augmented reality or virtual reality means that user actions at least partially determine what happens within the virtual space.

"rendering" means providing in a form that is perceived by the user, e.g. visually (viewed) or aurally (listened to) by the user.

"displaying" means providing in a form that is perceived visually (viewed) by the user.

"virtual user" refers to a user within the virtual space, e.g. a user immersed in a mediated/virtual/augmented reality. Virtual user defines the point-of-view (virtual position—location and/or orientation) in virtual space used to generate a perspective-mediated sound scene and/or visual scene. A virtual user may be a notional listener and/or a notional viewer.

"notional listener" defines the point-of-view (virtual position—location and/or orientation) in virtual space used to generate a perspective-mediated sound scene, irrespective of whether or not a user is actually listening.

"notional viewer" defines the point-of-view (virtual position—location and/or orientation) in virtual space used to generate a perspective-mediated visual scene, irrespective of whether or not a user is actually viewing.

"three degrees of freedom (3DoF)" describes mediated reality where the virtual position is determined by orientation only (e.g. the three degrees of three-dimensional orientation). An example of three degrees of three-dimensional orientation is pitch, roll and yaw (i.e. just 3DoF rotational movement). In relation to first person perspective-mediated reality 3DoF, only the user's orientation determines the virtual position.

"six degrees of freedom (6DoF)" describes mediated reality where the virtual position is determined by both orientation (e.g. the three degrees of three-dimensional orientation) and location (e.g. the three degrees of three-dimensional location), i.e. 3DoF rotational and 3DoF translational movement. An example of three degrees of three-dimensional orientation is pitch, roll and yaw. An example of three degrees of three-dimensional location is a three-dimensional coordinate in a Euclidian space spanned by orthogonal axes such as left to right (x), front to back (y) and down to up (z) axes. In relation to first person perspective-mediated reality 6DoF, both the user's orientation and the user's location in the real space determine the virtual position. In relation to third person perspective-mediated reality 6DoF, the user's location in the real space does not determine the virtual position. The user's orientation in the real space may or may not determine the virtual position.

"three degrees of freedom 'plus' (3DoF+)" describes an example of six degrees of freedom where a change in location (e.g. the three degrees of three-dimensional location) is a change in location relative to the user that can arise from a postural change of a user's head and/or body and does not involve a translation of the user through real space by, for example, walking.

"spatial rendering" refers to a rendering technique that renders content as an object at a particular three-dimensional position within a three-dimensional space.

"spatial audio rendering" refers to a rendering technique that renders audio as one or more virtual sound objects that have a three-dimensional position in a three-dimensional virtual sound space. Various different spatial audio rendering techniques are available. For example, a head-related transfer function may be used for spatial audio rendering in a binaural format or amplitude panning may be used for spatial audio rendering using loudspeakers. It is possible to control not only the position of a virtual sound object but it is also possible to control the spatial extent of a virtual sound object by distributing the audio object across multiple different spatial channels that divide the virtual sound space into distinct sectors, such as virtual sound scenes and virtual sound sub-scenes.

"spatial audio" is the rendering of a virtual sound scene. "First person perspective spatial audio" or "immersive audio" is spatial audio where the user's point-of-view determines the virtual sound scene, or "virtual sub-sound scene" ("virtual sub-audio scene") so that audio content selected by a current point-of-view of the user is rendered to the user.

"immersive audio" refers to the rendering of audio content to a user, wherein the audio content to be rendered is selected in dependence on a current point-of-view of the user. The user therefore has the experience that they are immersed within a three-dimensional audio field/sound scene/audio scene, that may change as their point-of-view changes.

DETAILED DESCRIPTION

The Figures schematically illustrate an apparatus 1000 comprising means configured for:

- receiving a first audio signal 1101 representative of a virtual sound scene 601, wherein the first audio signal 1101 is configured for rendering on an arrangement of loudspeakers 602 such that, when rendered on the arrangement of loudspeakers 602, the virtual sound scene 601 is rendered to a user 604;
- determining a first portion 601*a* of the virtual sound scene 601 to be rendered on headphones 603 of the user 604;
- generating a second audio signal 1102 representative of the first portion 601*a* of the virtual sound scene 601, wherein the second audio signal 1102 is configured for rendering on the headphones 603;
- determining a second portion 601*b* of the virtual sound scene 601 to be rendered on the arrangement of loudspeakers 602;
- generating a third audio signal 1103, representative of the second portion 601*b* of the virtual sound scene 601, wherein the third audio signal 1103 is configured for rendering on the arrangement of loudspeakers 602; and
- wherein the second and third audio signals 1102,1103 are generated such that, when rendered on the headphones 603 and the arrangement of loudspeakers 602 respectively, an augmented version of the virtual sound scene 601 is rendered to the user.

For the purposes of illustration and not limitation, various, but not necessarily all, examples of the disclosure may provide the technical advantage of improved rendering of audio. Enhanced spatial rendering of a first audio signal 1101, which is representative of spatial audio comprising a virtual sound scene 601, may be provided by dividing/splitting up the first audio signal 1101 into two audio signals 1102,1103:

- one signal 1102, representative of a first portion 601*a* of the virtual audio scene, to be rendered on headphones 603,
- the other audio signal 1103, representative of a second portion 601*b* of the virtual sound scene 601, to be rendered by loudspeakers 602.

The two audio signals 1101,1102 may be rendered simultaneously respectively on the headphones 603 and the loudspeakers 602, thereby reproducing/recreating the virtual sound scene in an enhanced/augmented form 601' via both of the headphones 603 and the loudspeakers 602. Advantageously, the rendering of the virtual sound scene 601 is not limited to being rendered merely just via the loudspeakers 602. Instead the rendering can be enhanced by the additional use of the headphones 603. For example, rather than being limited to spatial audio rendering solely via loudspeakers, e.g. wherein the spatial audio rendering is provided via the loudspeakers using amplitude panning, instead the spatial audio rendering may additionally use headphones such that, for example a head-related transfer function may be used for rendering a part of the spatial audio via the headphones in a binaural format. Furthermore, the virtual sound scene can be augmented/modified, for example by changing a virtual position p1 of a first virtual sound object 601$a_1$ in the virtual sound scene 601 to a new position p2 of the first virtual sound object 601$a_1$ in the modified virtual sound scene 601'. The first virtual sound object 601$a_1$, with its modified virtual position p2, can be included in the second audio signal 1102 for rendering via the headphones 603 rather than the loudspeakers 602. For example, a virtual sound scene 601 may be stereo widened 601'. Such control of the spatial rendering of may enhance a user's listening experience and improve the quality of rendering of spatial audio.

FIGS. 1A-3B schematically illustrate examples of: real space, virtual audio space and virtual visual space for use with examples of the subject matter described herein. Whilst subsequent FIGS. and discussions of examples of the disclosure focus on the audio domain, i.e. the rendering of a virtual audio scene of a virtual audio space, it is to be appreciated that such examples of the disclosure may be used in the audio/visual domain, i.e. involving the rendering of both a virtual audio scene as well as a virtual visual scene to provide a mediated reality environment to the user (e.g. an immersive AR or VR environment).

Figure 2A:
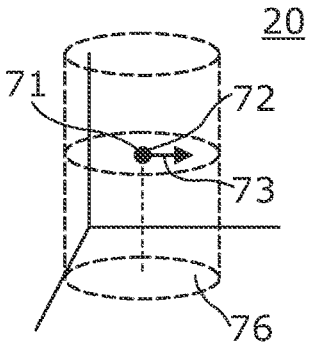
FIGS. 2A and 2B schematically illustrate an example virtual audio space for use with examples of the subject matter described herein.
Figure 3A:
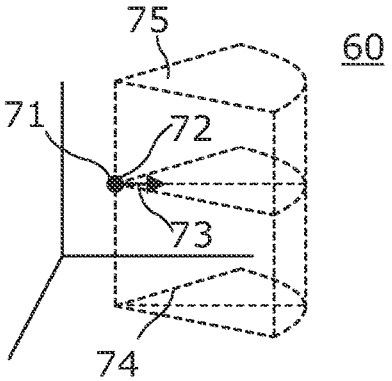
FIGS. 3A and 3B schematically illustrate an example virtual visual space for use with examples of the subject matter described herein.

FIGS. 1A, 2A and 3A illustrate an example of first-person perspective mediated reality. In this context, mediated reality means the rendering of mediated reality for the purposes of achieving mediated reality for a remote user, for example augmented reality or virtual reality. It may or may not be user interactive. The mediated reality may support one or more of: 3DoF, 3DoF+ or 6DoF.

FIGS. 1A, 2A and 3A illustrate, at a first time, each of: a real space 50, a virtual sound space 20 and a virtual visual space 60 respectively. There is correspondence between the virtual sound space 20 and the virtual visual space 60. A 'virtual space' may be defined as the virtual sound space 20 and/or the virtual visual space 60. In some examples, the virtual space may comprise just the virtual sound space 20. A user 51 in the real space 50 has a position defined by a (real world) location 52 and a (real world) orientation 53 (i.e. the user's real-world point-of-view). The location is a three-dimensional location and the orientation is a three-dimensional orientation.

In an example of 3DoF mediated reality, an orientation/real point-of-view 53 of the user 51 controls/determines a virtual orientation/virtual point-of-view 73 of a virtual user 71 within a virtual space, e.g. the virtual sound space 20 and/or the virtual visual space 60. The virtual user 71 represents the user 51 within the virtual space. There is a correspondence between the orientation 53 and the virtual orientation 73 such that a change in the (real world) orientation 53 produces the same change in the virtual orientation 73. In 3DoF mediated reality, a change in the location 52 of the user 51 does not change the virtual location 72 or virtual orientation 73 of the virtual user 71.

The virtual orientation 73 of the virtual user 71, in combination with a virtual field of view 74 defines a virtual visual scene 75 of the virtual user 71 within the virtual visual space 60. The virtual visual scene 75 represents a virtual observable region within the virtual visual space 60 that the virtual user can see. Such a 'virtual visual scene 75 for the virtual user 71' may correspond to a virtual visual 'sub-scene'. The virtual visual scene 75 may determine what visual content (and virtual visual spatial position of the same with respect to the virtual user's position) is rendered to the virtual user. In a similar way that the virtual visual scene 75 of a virtual user may affect what visual content is rendered to the virtual user, a virtual sound scene 76 of the virtual user may affect what audio content (and virtual aural spatial position of the same with respect to the virtual user's position) is rendered to the virtual user.

The virtual orientation 73 of the virtual user 71, in combination with a virtual field of hearing (i.e. an audio equivalent/analogy to a visual field of view) may define a virtual sound scene (or audio scene) 76 of the virtual user 71 within the virtual sound space (or virtual audio space) 20. The virtual sound scene 76 represents a virtual audible region within the virtual sound space 20 that the virtual user can hear. Such a 'virtual sound scene 76 for the virtual user 71' may correspond to a virtual audio 'sub-scene'. The virtual sound scene 76 may determine what audio content (and virtual spatial position/orientation of the same) is rendered to the virtual user.

A virtual sound scene 76 is that part of the virtual sound space 20 that is rendered/audibly output to a user. A virtual visual scene 75 is that part of the virtual visual space 60 that is rendered/visually displayed to a user. The virtual sound space 20 and the virtual visual space 60 correspond in that a position within the virtual sound space 20 has an equivalent position within the virtual visual space 60. In 3DoF mediated reality, a change in the location 52 of the user 51 does not change the virtual location 72 or virtual orientation 73 of the virtual user 71.

In the example of 6DoF mediated reality, the situation is as described for 3DoF and in addition it is possible to change the rendered virtual sound scene 76 and the displayed virtual visual scene 75 by movement of a location 52 of the user 51. For example, there may be a mapping between the location 52 of the user 51 and the virtual location 72 of the virtual user 71. A change in the location 52 of the user 51 produces a corresponding change in the virtual location 72 of the virtual user 71. A change in the virtual location 72 of the virtual user 71 changes the rendered virtual sound scene 76 and also changes the rendered virtual visual scene 75.

Figure 1B:
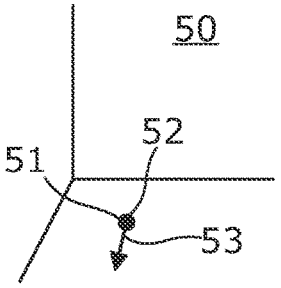
Figure 2B:
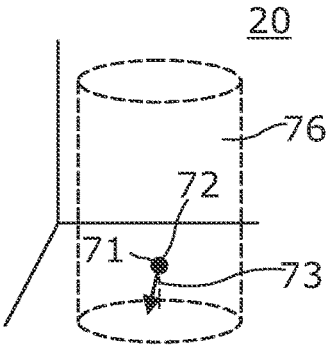
Figure 3B:
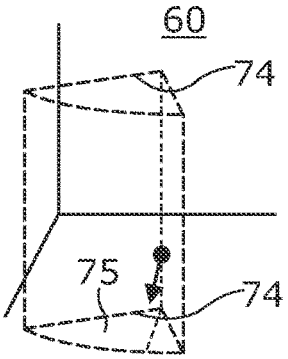

This may be appreciated from FIGS. 1B, 2B and 3B which illustrate the consequences of a change in position, i.e. a change in location 52 and orientation 53, of the user 51 on respectively the rendered sound scene 76 (FIG. 2B) and the rendered virtual visual scene 75 (FIG. 3B).

Immersive or spatial audio (for 3DoF/3DoF+/6DoF) may consist, e.g., of a channel-based bed and audio objects, first-order or higher-order ambisonics (FOA/HOA) and audio objects, any combination of these such as audio objects only, or any equivalent spatial audio representation.

MPEG-I, which is currently under development, is expected to support new immersive voice and audio services, including methods for various mediated reality, virtual reality (VR), augmented reality (AR) or mixed reality (MR) use cases with each of 3DoF, 3DoF+ and 6DoF use cases MPEG-I is expected to support dynamic inclusion of audio elements in a virtual sound sub-scene based on their relevance, e.g., audibility relative to the virtual user location, orientation, direction and speed of movement or any other virtual sound scene change movement in virtual space. MPEG-I is expected to support metadata to allow fetching of relevant virtual sub sound scenes, e.g., depending on the virtual user location, orientation or direction and speed of movement in virtual space. A complete virtual sound scene may be divided into a number of virtual sound sub-scenes, defined as a set of audio elements, acoustic elements and acoustic environments. Each virtual sound sub-scene could be created statically or dynamically.

The MPEG-I 6DoF Audio draft requirements also described Social VR, i.e. facilitating communication between users that are in the same virtual world or between a user in a virtual world and one outside the virtual world.

MPEG-I is expected to support rendering of speech and audio from other virtual users in a virtual space, such speech and audio may be immersive. MPEG-I is expected to support metadata specifying restrictions and recommendations for rendering of speech/audio from the other users (e.g. on placement and sound level).

Figure 4:
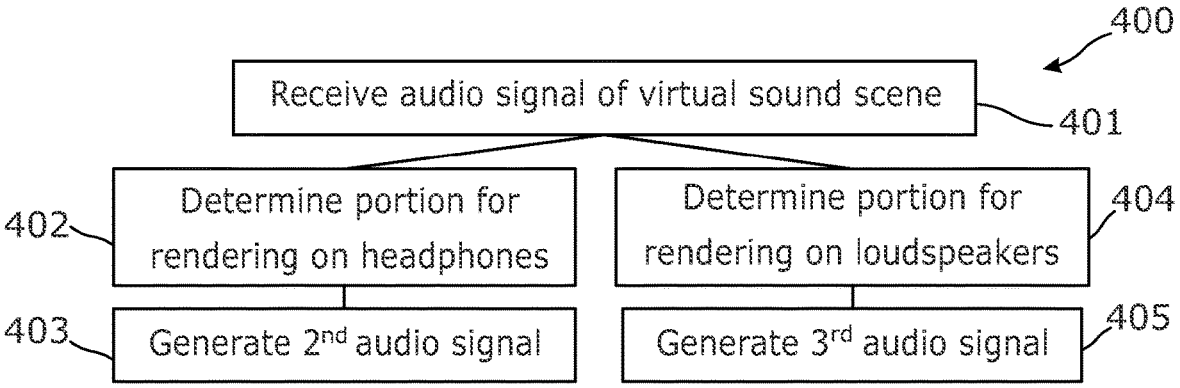
FIG. 4 schematically illustrates an example method of the subject matter described herein.

FIG. 4 schematically illustrates a flow chart of a method 400 according to an example of the present disclosure. The component blocks of FIG. 4 are functional and the functions described may or may not be performed by a single physical entity (such as the apparatus 1000 described with reference to FIG. 10).

In block 401, a first audio signal 1101, representative of a virtual sound scene 601 is received. The first audio signal 1101 is configured for rendering on an arrangement of loudspeakers 602 such that, when rendered on the arrangement of loudspeakers, the virtual sound scene is rendered to a user 604.

In block 402, a determination is made of a first portion 601*a* of the virtual sound scene 601 to be rendered on headphones 603 of the user 604.

In block 403, a second audio signal 1102, representative of the first portion 601*a* of the virtual sound scene 601, is generated. The second audio signal is configured for rendering on the headphones 603.

In block 404, a determination is made of a second portion 601*b* of the virtual sound scene 601 to be rendered on the arrangement of loudspeakers 602. Block 404 may be performed together with the performance of block 402, e.g. such that they may be performed simultaneously/in parallel with one another.

In block 405, a third audio signal 1103, representative of the second portion 601*b* of the virtual sound scene 601 is generated, wherein the third audio signal is configured for rendering on the arrangement of loudspeakers 602.

The second 1102 and third 1103 audio signals are generated such that, when rendered on the headphones 603 and the arrangement of loudspeakers 602 respectively, an augmented version of the virtual sound scene 601' is rendered to the user 604.

In some examples of the present disclosure, the rendering of the virtual sound scene may be augmented by the rendering of one or more parts of the virtual sound scene via the headphones whilst one or more other parts of the virtual sound scene are simultaneously rendered via the loudspeakers.

The flowchart of FIG. 4 represents one possible scenario among others. The order of the blocks shown is not absolutely required, so in principle, the various blocks can be performed out of order. Not all the blocks are essential.

The blocks illustrated in FIG. 4 can represent actions in a method and/or sections of instructions in a computer program. It will be understood that each block and combinations of blocks, can be implemented by various means, such as hardware, firmware, and/or software including one or more computer program instructions. For example, one or more of the procedures described above can be embodied by computer program instructions. In this regard, the computer program instructions which embody the procedures described above can be stored by a memory storage device and performed by a processor.

As will be appreciated, any such computer program instructions can be loaded onto a computer or other programmable apparatus (i.e., hardware) to produce a machine, such that the instructions when performed on the programmable apparatus create means for implementing the functions specified in the blocks. These computer program instructions can also be stored in a computer-readable medium that can direct a programmable apparatus to function in a particular manner, such that the instructions stored in the computer-readable memory produce an article of manufacture including instruction means which implement the function specified in the blocks. The computer program instructions can also be loaded onto a programmable apparatus to cause a series of operational actions to be performed on the programmable apparatus to produce a computer-implemented process such that the instructions which are performed on the programmable apparatus provide actions for implementing the functions specified in the blocks.

The first audio signal 1101 can be used to denote a signal for representing a virtual sound scene 601 comprising one or more virtual sound objects 601$a_1$,601$a_2$,601$b$ each having a virtual position (i.e. virtual location and orientation) in the virtual sound scene. The first audio signal 1101 can, for example, be: a spatial audio signal, a multichannel audio signal, or a MPEG-I signal.

As used herein, the term "loudspeaker" means an audio output device (such as an electroacoustic transducer configured to convert an electrical audio signal into a corresponding sound) configured for far field listening distal to a user's ears, e.g. greater than 10 cm from a user's ear, [c.f. being configured for near field listening such as headphones]. A loudspeaker may comprise one or more drivers for reproducing: high audio frequencies (such drivers known as "tweeters"), middle frequencies (such drivers known as "mid-range drivers"), low frequencies (such drivers known as "woofers"), and very low frequencies (such drivers known as "subwoofers").

As used herein, the term "arrangement of loudspeakers" can used to denote a real-world array of a plurality of physical audio output devices (c.f. virtual loud speakers) configured for far field listening. Such an arrangement may comprise: a multi-channel loudspeaker set-up, a pair of stereo speakers (e.g. Left (L) and Right (R) loudspeakers), a 2.1 loudspeaker setup (i.e. L, R and subwoofer loudspeakers), a surround sound arrangement of loudspeakers, (e.g. a home theatre speaker setup such as a 5.1 surround sound—comprising loudspeakers: Centre (C) in front of the user/listener, Left (L) and Right (R) on either side of the centre, and Left Surround (LS) and Right Surround (RS) on either side behind the user/listener, and a subwoofer). The arrangement of loudspeakers may be predetermined, i.e. wherein the relative positions and orientations of each loudspeaker relative to one another (and also, optionally, to the user) are pre-known (or determined, such as via automated detection or user input).

As used herein, the term "headphones" can be used to denote an array of a plurality of wearable/head mountable audio output devices configured for near field listening, proximal to a user's ears, e.g. less than 5 cm from a user's ear, [c.f. being configured for far field listening such as loudspeakers]. Headphones may permit a single user to listen to an audio source privately, in contrast to a loudspeaker, which emits sound into the open air for anyone nearby to hear. Headphones can, for example, be: circum-aural headphones ('around the ear'), supra-aural headphones ('over the ear'), ear bud headphones or in-ear headphones. Headphones can, for example, be: earphones, earbuds, ear speakers, head mountable speakers and wearable speakers. Headphones may be comprised in: a headset, a head mountable audio/visual display device for rendering: MR, AR or VR A/V content (for example: a Head Mountable Display (HMD), a visor, a glasses, or goggles such as Microsoft Hololens®).

Figure 5:
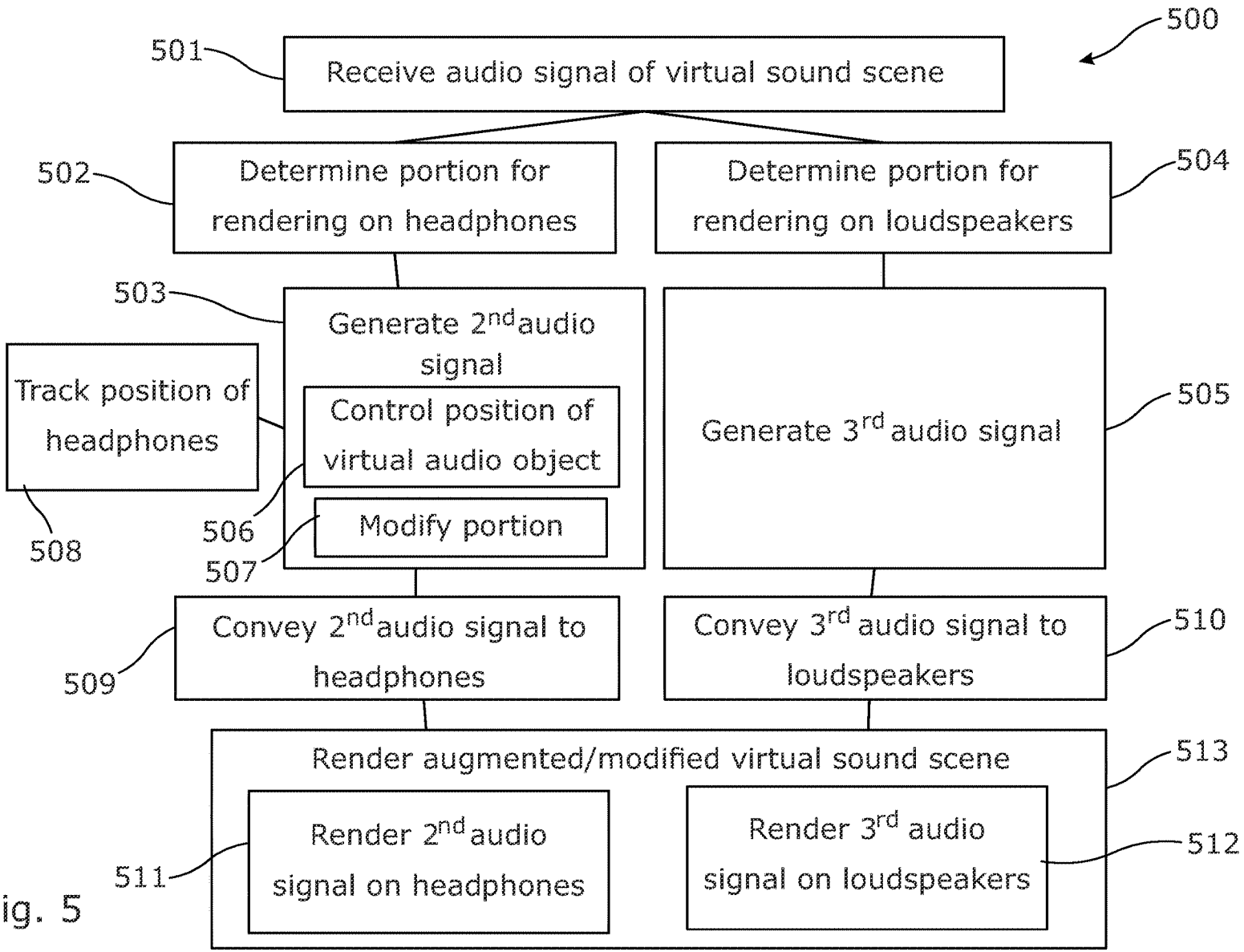
FIG. 5 schematically illustrates a further example method of the subject matter described herein.

FIG. 5 schematically illustrates a flow chart of another method 500 according to an example of the present disclosure. The component blocks of FIG. 5 are functional and the functions described may or may not be performed by a single physical entity (such as is described with reference to FIG. 10).

Blocks 501-505 correspond to those of block 401-405 of FIG. 4.

In some examples (e.g. as per FIG. 6B discussed in further detail below) in block 502, the determining the first portion 601$a$ of the virtual sound scene 601 to be rendered on the headphones 603 may comprise determining one or more virtual sound objects 601$a_1$,601$a_2$ to be stereo widened i.e. determining one or more virtual sound objects whose virtual orientation (azimuthal angle) with respect to the user is to be increased. The virtual sound scene 601 may comprise a first virtual sound object 601$a_1$ having a first virtual position p1, i.e. virtual location and virtual orientation l1,o1. The determined first portion 601$a$ may comprise at least the first virtual sound object 601$a_1$. The determined first portion 601$a$ may differ from the determined second portion 601$b$. The determined second portion 601$b$ may be devoid of the at least first virtual sound object 601$a_1$.

In some examples (e.g. as per FIG. 7B discussed in further detail below) in block 502, the determining the first portion 701$a_1$ of the virtual sound scene 701 to be rendered on the headphones 603 may comprise determining one or more virtual sound objects 701$a_1$,701$a_2$ whose virtual distance crosses a threshold virtual distance 705. In some examples, e.g. FIG. 7B, crossing the threshold virtual distance comprises the virtual distance of one or more virtual sound objects 701$a_1$,701$a_2$ to the user being less than a threshold virtual distance 705.

In block 506, the virtual position p1 of the first virtual sound object 601$a_1$ is controlled, i.e. the second audio signal 1102 is generated such that, when the generated second audio signal is rendered on the headphones 603, the virtual position of the first virtual sound object 601$a_1$ is controlled. In some examples, the virtual position is controlled to have a different virtual position p2 to that of the first virtual position p1 of the first virtual sound object 601$a_1$ (e.g. as per the example of FIG. 6B, as well as FIGS. 7B, 9C). In some examples, the virtual position is controlled to have the substantially the same virtual position to that of the initial virtual position p1 of the first virtual sound object (e.g. as per the examples of FIGS. 8B and 9B).

In block 507, the second audio signal 1102, which is representative of the first portion 601$a$ of the virtual sound scene 601, is modified; i.e. the second audio signal is generated such that, when rendered on the headphones 603, a modified version of the first portion 601$a_1$' is rendered to the user 604. In some examples the modified portion 601$a_1$' of the virtual sound scene 601 corresponds to an adjusted virtual position of the virtual sound object 601$a_1$.

In blocks 503 and 505, the generating of the second audio signal 1102 and the third audio signal 1103 may comprise generating the second and third audio signals such that, when the second and third signals 1103 are simultaneously rendered on the headphones 603 and the arrangement of loudspeakers 602 respectively, they are perceived by the user to be in temporal synchronisation. This may involve applying a delay in one or other of the second and third audio signals 1102, 1103. For example, it may be assumed that all locations (user, loudspeakers, sound objects) are known. Each loudspeaker signal may be "advanced" by the time it takes sound to travel from that loudspeaker to the user's location (the user's location also corresponding to the headphone location). Since, in practise one cannot "advance" signals, instead the headphone signal may be delayed by amount A and each loudspeaker signal is delayed by an amount B1, B2, . . . where Bi<A and A−Bi is the time that sound travels from loudspeaker i to the user's location.

In block 508, the position, i.e. location and orientation, of the headphones 603 is tracked, i.e. detected and measured. Such tracking may be used in the generation and/or rendering of the second audio signal 1102. The generation of the second audio signal may be dependent upon the tracked position. For example, the position p2 of the modified virtual sound object 601$a_1$' may be controlled based on the tracked position, i.e. such that the position p2 in virtual sound space remains fixed in spite of the user rotating his/her head thereby changing his/her point of view (and hence changing the position of the headphones) such that the perceived virtual position p2 of the virtual sound object 601$a_1$ is invariant with respect to such user/headphone movement. In such manner, a "real world" fixing of the perceived position of the virtual sound object 601$a_1$ may be provided. The tracking of the headphones' position may be performed via any appropriate process/means. In some examples, tracking the position of the headphones 603 may involve utilising a plurality of beacons/base stations emitting infrared signals from known locations. Such infrared signals may be detected by via an array of infrared sensors, e.g. on the headphones. Such detected infrared signals may be used to calculate a position (location and orientation) of the headphones. In other examples, a depth sensor may be used, e.g. comprising a CMOS sensor and an infrared/near-infrared projector mounted on the headphones, to measure the distance of objects in the surroundings (e.g. walls/ceiling of a room) by transmitting near-infrared light and measuring its "time of flight" after it reflects off the objects.

The generating of the second audio signal 1102 in block 503 may comprise transforming the second audio signal for spatial audio rendering on the headphones, preferably by applying a head-related transfer function to modify the second audio signal for use for spatial audio rendering in a binaural format. In such a manner, the rendering of the second audio signal may provide: immersive audio to the user, a perspective-mediated virtual sound scene, and/or head tracked audio.

In blocks 509 and 510, the second and third audio signals 1102,1103 are conveyed to the headphones 603 and loudspeakers 602 respectively for rendering therefrom.

In block 511 and 512, the second and third audio signals 1102,1103 are rendered via the headphones 603 and loudspeakers 602 respectively, thereby rendering an augmented (and optionally a modified) version of the virtual sound scene 601' as per block 513. In some examples (e.g. as per FIG. 6B), wherein the second virtual position p2 of the virtual sound object 601$a_1$' differs from the first virtual position p1 of the virtual sound object 601$a_1$, such that the first portion of the sound scene is modified, the resultant rendered virtual sound scene represents a modified virtual sound scene 601' to the user, i.e. wherein the perceived position of the virtual sound object 601$a_1$' in the resultant virtual sound scene 600' rendered by the combination of the headphones and loudspeakers differs from the virtual sound scene 600 as would have been rendered by the loudspeakers alone.

The flowchart of FIG. 5 represents one possible scenario among others. The order of the blocks shown is not absolutely required, so in principle, the various blocks can be performed out of order. Not all the blocks are essential.

In certain examples one or more blocks can be performed in a different order or overlapping in time, in series or in parallel. One or more blocks can be omitted or added or changed in some combination of ways.

Various examples of the present disclosure are described using flowchart illustrations and schematic block diagrams. It will be understood that each block (of the flowchart illustrations and block diagrams), and combinations of blocks, can be implemented by computer program instructions of a computer program. These program instructions can be provided to one or more processor(s), processing circuitry or controller(s) such that the instructions which execute on the same create means for causing implementing the functions specified in the block or blocks, i.e. such that the method can be computer implemented. The computer program instructions can be executed by the processor(s) to cause a series of operational steps/actions to be performed by the processor(s) to produce a computer implemented process such that the instructions which execute on the processor(s) provide steps for implementing the functions specified in the block or blocks.

Accordingly, the blocks support: combinations of means for performing the specified functions; combinations of actions for performing the specified functions; and computer program instructions/algorithm for performing the specified functions. It will also be understood that each block, and combinations of blocks, can be implemented by special purpose hardware-based systems which perform the specified functions or actions, or combinations of special purpose hardware and computer program instructions.

Figure 6A:
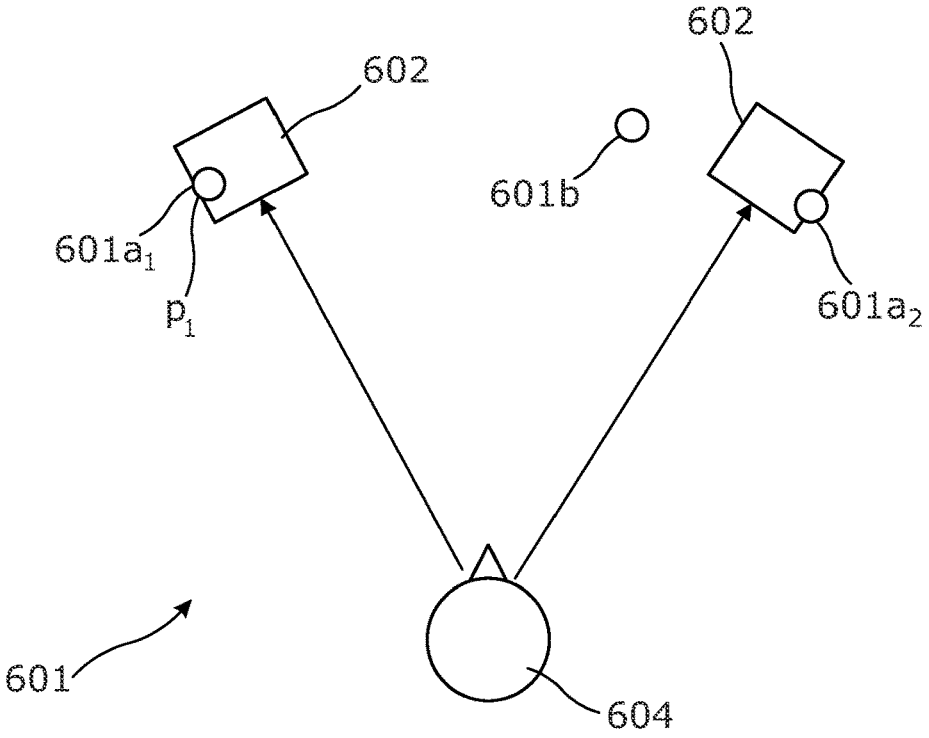
FIGS. 6A and 6B schematically illustrate an example use case of the subject matter described herein.

The example of FIG. 6A schematically illustrates a virtual sound scene 601 (represented by a first audio signal of spatial audio) rendered to a user 604 by an arrangement of loudspeakers 602, in this case a pair of stereo loudspeakers e.g. in the user's living room. The virtual sound scene comprises a plurality of virtual sound objects 601$a_1$, 601$a_2$ and 601$b$ each having a respective virtual position, e.g. p1 for 601$a_1$, in the virtual sound scene. The perceived 'stereo width' of the rendered virtual sound scene may be limited by the separation distance between the loudspeakers and their relative physical arrangement with respect to the user. A user wishing to widen the virtual sound scene could do so by physically increasing the separation distance of the loudspeakers, but this may have an adverse affect on the rendering quality of virtual sound objects having a virtual position in the central region between the loudspeakers—where oftentimes the virtual sound objects of interest (e.g. dialogue) is typically rendered.

Figure 6B:
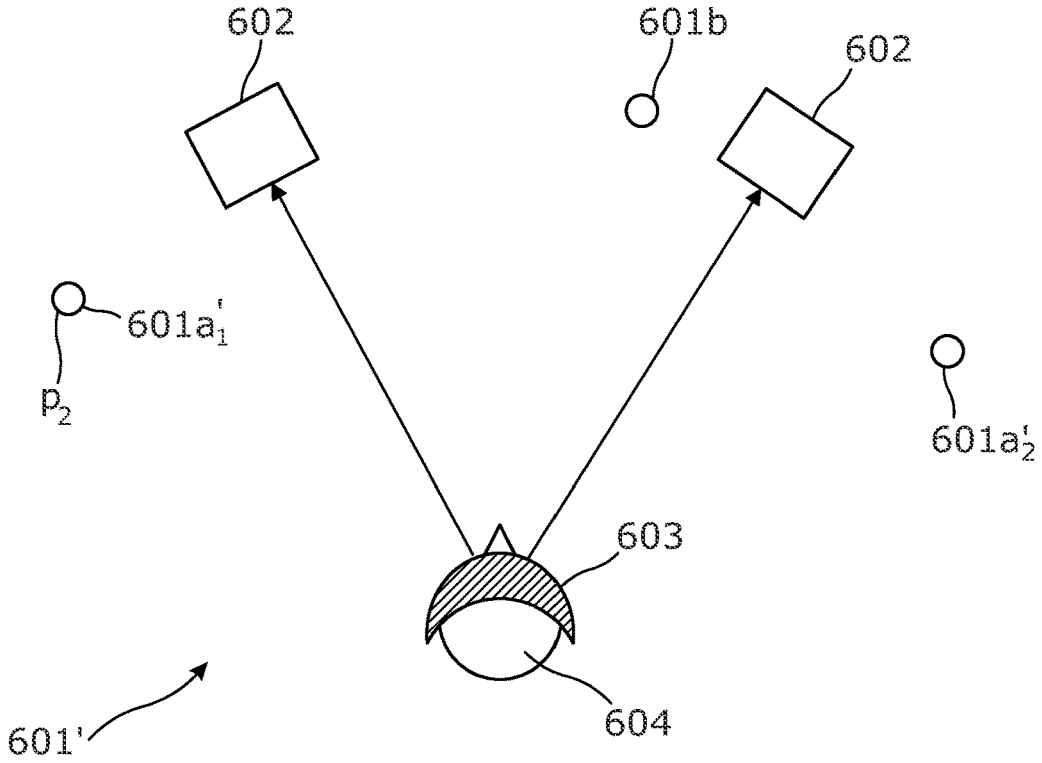

The example of FIG. 6B schematically illustrates an augmented virtual sound scene 601' rendered by both the arrangement of loudspeakers 602 and headphones 603, in this case headphones of AR glasses, worn by the user 604. A portion of virtual sound scene 601*a* to be stereo widened is determined, such a portion corresponding in this case to virtual sound objects 601$a_1$ and 601$a_2$. A second audio signal is generated comprising the virtual sound objects 601$a_1$' and 601$a_2$'. The second audio signal is configured such that, when rendered from the headphones, the virtual position of the virtual sound objects differs from their respective initial virtual position, e.g. the virtual position p1 of virtual sound object 601$a_1$ is moved to p2 (and likewise occurs for virtual sound object 601$a_2$) so as to give rise to a stereo widening effect. A third audio signal is generated comprising the rest of the virtual sound scene and its remaining virtual sound object(s) 601*b*, which is rendered from the loudspeakers, wherein the virtual position of the same remains unaltered. Appropriate delays are used to synchronize the loudspeaker rendering/playback to the headset rendering/playback In the example of FIG. 6B, the loudspeakers just render the non-stereo widened part of the virtual sound scene, whilst the headphones render the stereo widened part of the virtual sound scene. Thus, there is little risk in decreasing the loudspeaker signal quality.

Figure 7A:
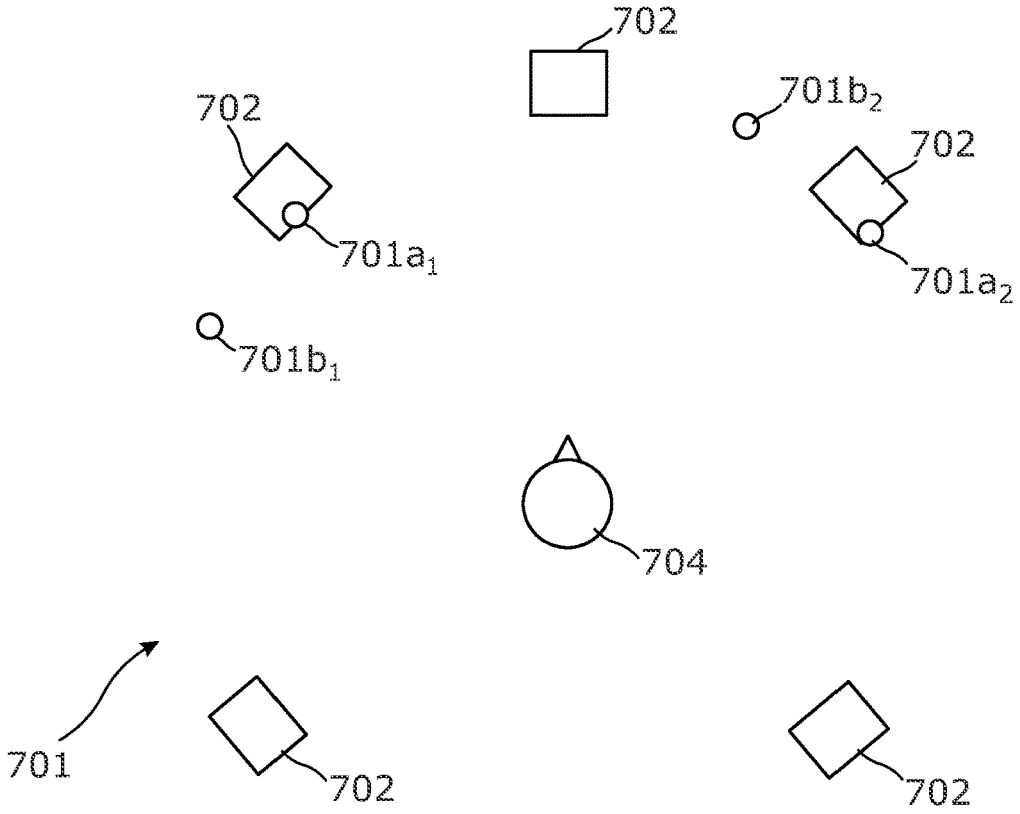
FIGS. 7A and 7B schematically illustrate a further example use case of the subject matter described herein.

The example of FIG. 7A schematically illustrates a virtual sound scene 701 (represented by a first audio signal) rendered by an arrangement of loudspeakers 702, in this case a 5.1 surround sound loudspeaker set up, to a user 704. The virtual sound scene comprises a plurality of virtual sound objects: 701$a_1$, 701$a_2$, 701$b_1$ and 701$b_2$.

Figure 7B:
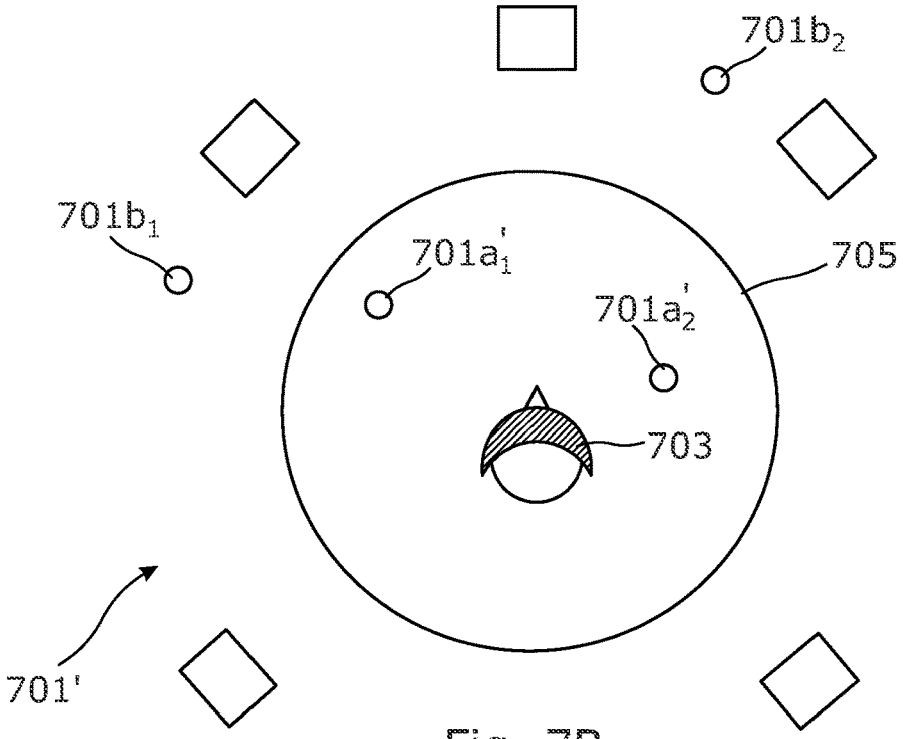

The example of FIG. 7B schematically illustrates an augmented virtual sound scene 701' rendered by both the arrangement of loudspeakers 702 and headphones 703. A portion of virtual sound scene 701*a* to be rendered on the headphones 703 is determined. Such a portion of the virtual sound scene 701*a* comprises determining the virtual sound objects of the virtual sound scene that are intended to have a "close" virtual position, i.e. virtual sound objects 701$a_1$, 701$a_2$ having a virtual position within a threshold virtual distance 705 from the user. Where the first audio signal is a spatial audio signal, the virtual position of the virtual sound objects may be encoded in the spatial audio signal. A second audio signal is generated comprising such virtually close/proximal virtual sound objects 701$a_1$' and 701$a_2$'. The second audio signal is configured such that, when rendered from the headphones, the virtual positions of the virtual sound objects differs from their initial virtual positions, i.e. such that their virtual positions are closer to the user. A third audio signal is generated comprising the rest of the virtual sound scene 701*b* and the remaining "far away" virtual sound objects 701$b_1$, 701$b_2$, which are rendered from the loudspeakers 702. Appropriate delays are used to synchronize the loudspeaker playback to the headset playback This example addresses issues of conventional purely loudspeaker-based rendering of spatial audio content which may provide suboptimal sound distance reproduction, particularly for virtual sound objects that are intended to be virtual sound objects "close/nearby/proximal" to the user. This example improves the rendering of spatial audio comprising far away virtual sound sources sound and close virtual sound sources. Whilst the far away virtual sound objects may sound better and be optimally rendered on the loudspeakers, the rendering of the close virtual sound objects may not sound to the user as close as they should be.

In some examples, wideband sounds or low frequency portions of virtual sound objects 601$a_1$,601$a_2$,701$a_1$,701$a_2$ (that would otherwise be rendered from headphones) are rendered from the loudspeakers rather than headphones; whilst the high frequency sounds or the high frequency portions of virtual sound objects 601$a_1$,601$a_2$,701$a_1$,701$a_2$ are rendered from the headphones.

Figure 8A:
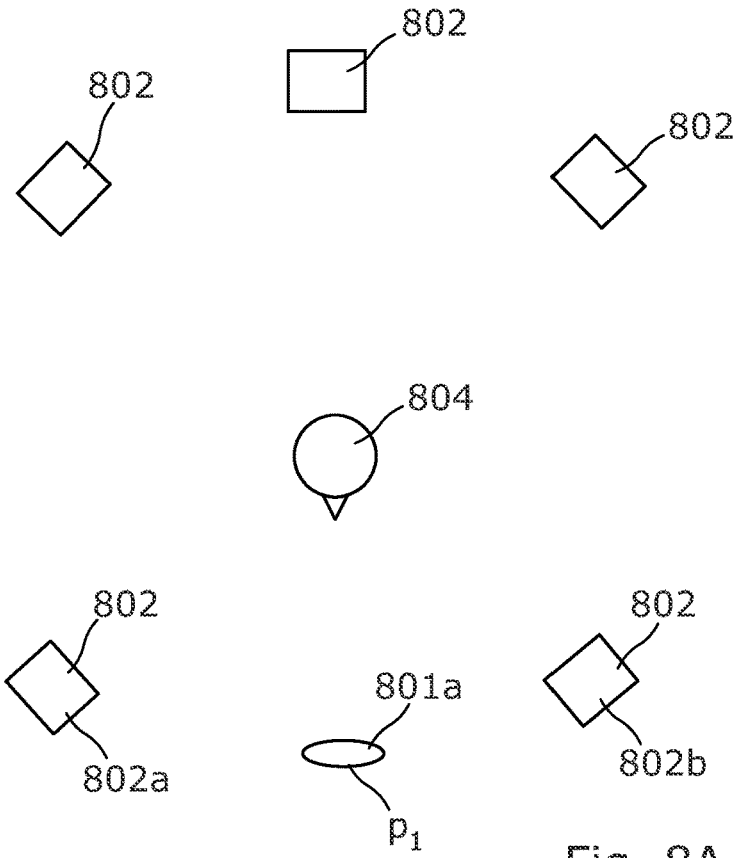
FIGS. 8A and 8B schematically illustrate a yet further example use case of the subject matter described herein.

The example of FIG. 8A schematically illustrates a user 804 listening to 6DoF content (represented by a first audio signal) with a loudspeaker array 802, i.e. a 5.1 surround sound set up. As the user is able to navigate through the aural content/virtual sound scene, it may be that interesting aural content, i.e. a particular virtual sound source 801*a* is at times virtually positioned between loudspeakers, e.g. between the rear loudspeakers 802*a*, 802*b*. However, since there is no middle/centre loudspeaker in the rear, the reproduction quality for virtual sound sources which fall in the middle rear may be suboptimal.

Figure 8B:
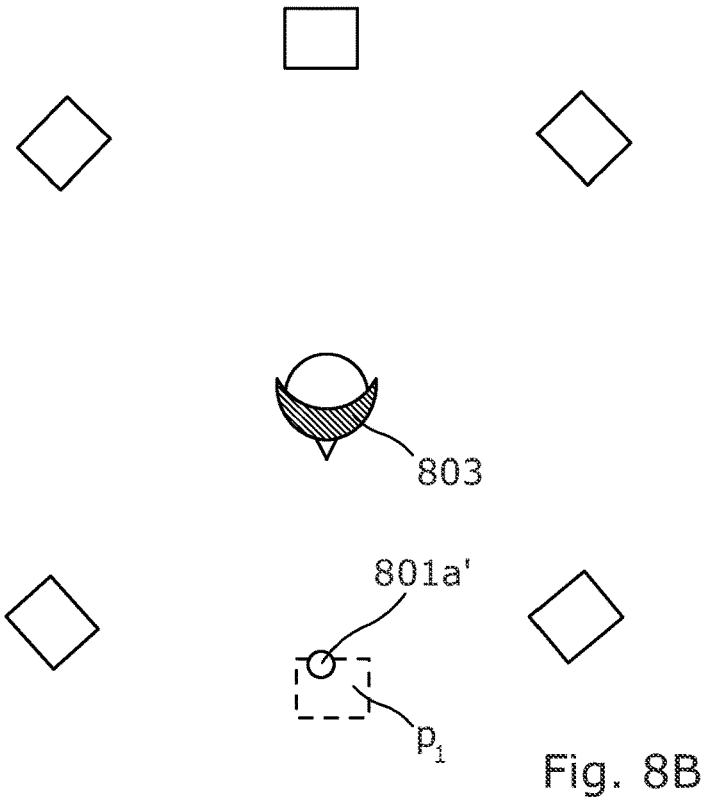

The example of FIG. 8B schematically illustrates headphones 803 being used for rendering the signal of such a "missing" physical loudspeaker. More specifically, the portion of audio signal 801*a* that should be rendered from a physical loudspeaker is rendered instead from a 'virtual speaker' using the headphones. An example use case is the user facing towards the back side of a 5.1 surround sound loudspeaker setup which does not have a speaker in the middle/centre rear. Another example may be where a loudspeaker setup only has the front channels of the 5.1 configuration (i.e. Left, Centre and Right loudspeakers but with no Rear Surround loudspeakers) and the Rear Surround loudspeakers' channels are rendered using the headphones.

This example addresses issues in purely loudspeaker-based rendering of spatial audio content which may provide suboptimal spatial audio reproduction where there may be too large a spacing between the loudspeakers resulting in suboptimal rendering of virtual sound objects whose virtual position is location in the vicinity of such spacing between loudspeakers. With examples of the disclosure, in effect 'virtual speakers' can be created and located at such locations where there are not enough physical speakers, thereby improving the audio quality of the rendered spatial audio.

Figure 9A:
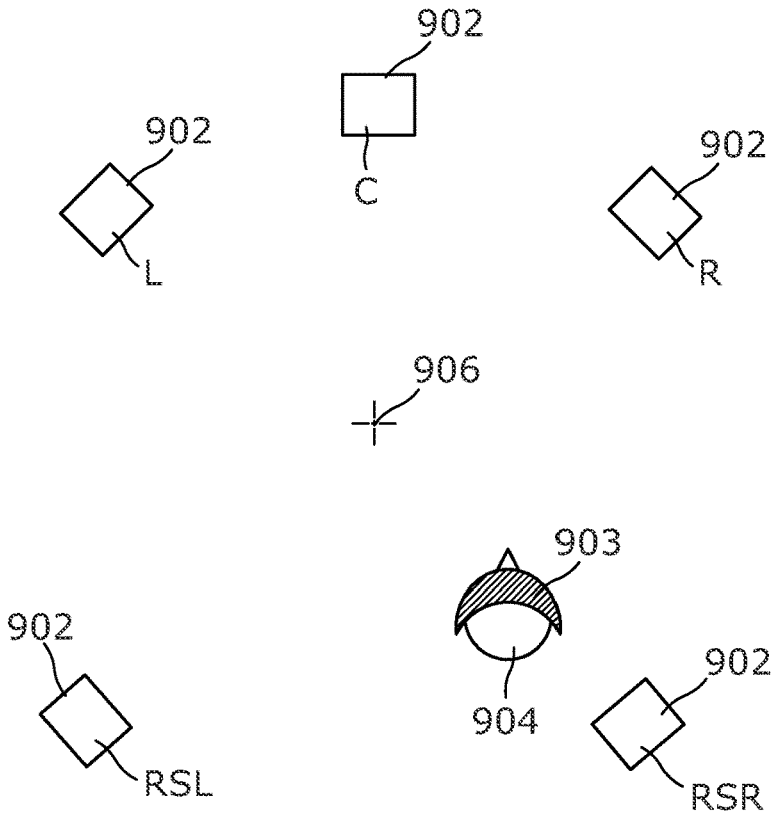
FIGS. 9A, 9B and 9C schematically illustrate a yet further example use cases of the subject matter described herein.

The example of FIG. 9A schematically illustrates a user 904 listening to content with a loudspeaker array 902, i.e. a 5.1 surround sound set up. However, the user is not able to be positioned in the "sweet spot" 906 (i.e. the reference/optimal listening point) of the surround sound set up. A rendered virtual sound scene perceived by the user outside of the sweet spot, e.g. at a position to the lower right-hand side of the sweet spot, is not perceived as optimally as it should be because the rear right loudspeaker signal is too loud since the user is too close to it, and the other loudspeaker signals are too quiet since the user is too far from them.

Figure 9B:
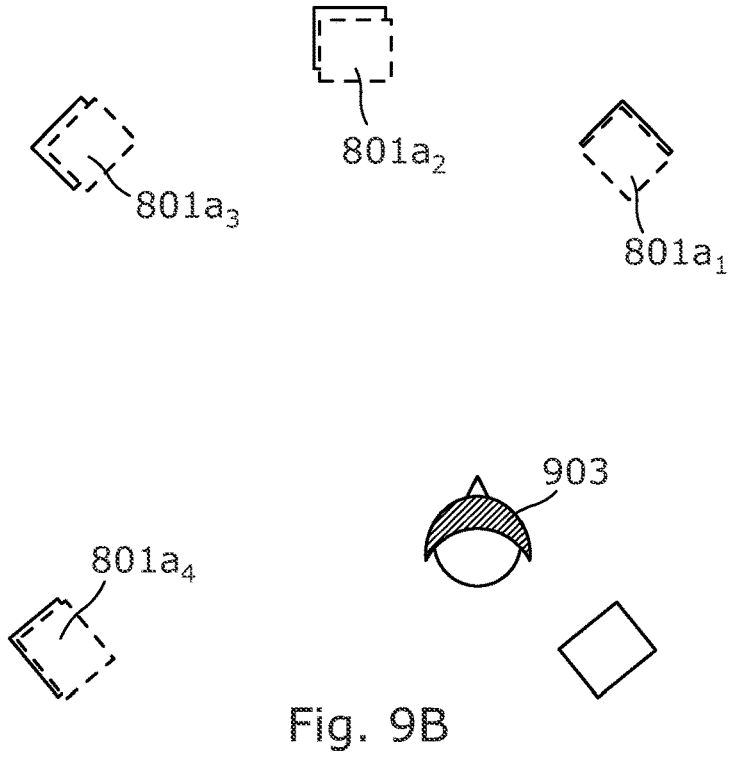

The example of FIG. 9B schematically illustrates the headphones being used for rendering the signal of physical loudspeakers which are too far from the user, i.e. whose distance is greater than a threshold distance from the user. More specifically, the portion of first audio signal that should be rendered from physical loudspeakers L, C, R and the Rear Surround Left "RSL" loudspeakers, are rendered from virtual speakers 801$a_1$,801$a_2$,801$a_3$,801$a_4$ using the headphones 903. An example use case is the user being too close to the RSR loudspeaker of a 5.1. In this case, the other loudspeaker signals, which are too quiet with the user in such a position, are additionally rendered as virtual loudspeaker signals via the headphones. In such a manner, the rendering of a portion of the virtual sound scene, namely 801$a_1$,801$a_2$,801$a_3$,801$a_4$, by the headphones augments the rendering of the same portion via their respective real physical loudspeakers, i.e. to boost the volume of the sounds rendered from such loudspeakers. The second audio signal, comprising a first portion of the virtual sound scene to be rendered by the headphones (namely in this case virtual sound objects that represent the virtual speakers whose virtual position corresponds to the respective real physical loudspeakers), is configured such that the virtual position of the virtual sound objects corresponds to the real position of the loudspeakers.

In some examples, the first audio signal is a multichannel audio signal with channels for the plurality of loudspeakers. The second audio signal may comprise a certain subset of the channels (albeit duly modified with a delay to ensure its rendering is in synchronization with the rendering of the channels via the loudspeakers, also the second audio signal may be duly modified so as to provide head tracked audio rendering).

Figure 9C:
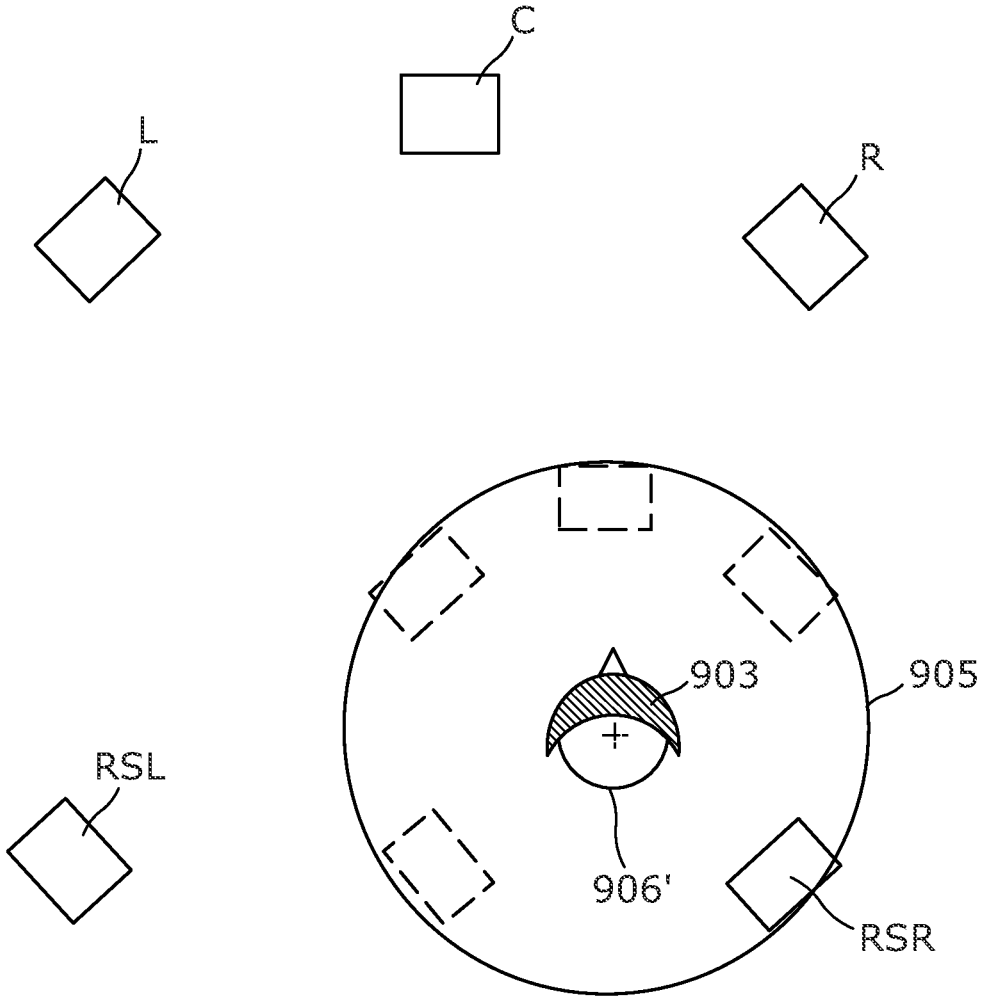

The example of FIG. 9C schematically illustrates a further example wherein the headphones 903 are used for rendering the signal of physical loudspeakers R, C, L, RSL which are too far from the user 904, i.e. loudspeakers whose distance is greater than a threshold distance 905 from the user. FIG. 9C schematically illustrates an alternative to the spatial audio rendering augmentation of FIG. 9B, wherein rather than creating virtual speakers to supplement the rendering of the audio signal from certain of the physical speakers (as per FIG. 9B), instead the virtual speakers replace the rendering of the audio signal from certain of the physical speakers (i.e. such that the location of the sweet spot/focal point of the virtual sound scene is, effectively, moved to a new position 906' centred on the user's actual current location.

Various, but not necessarily all, examples of the present disclosure can take the form of a method, an apparatus or a computer program. Accordingly, various, but not necessarily all, examples can be implemented in hardware, software or a combination of hardware and software.

Figure 10:
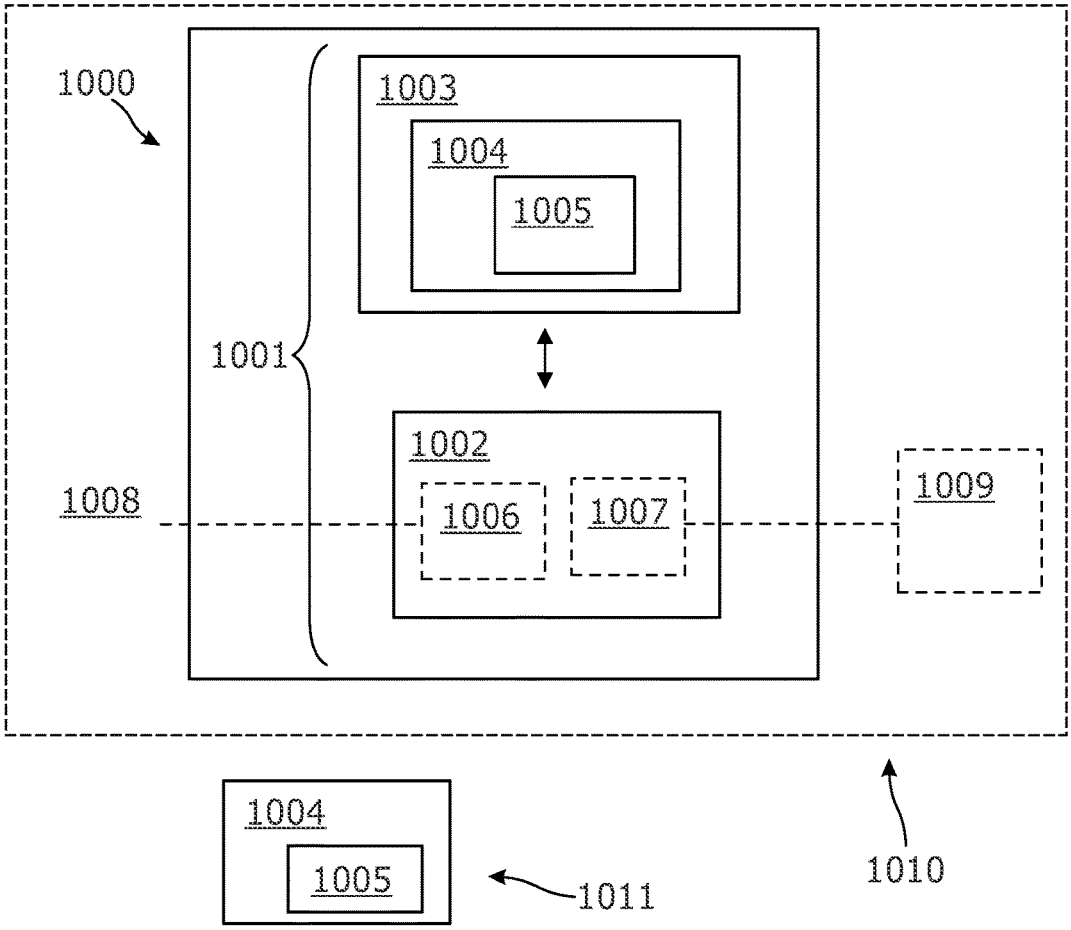
FIG. 10 schematically illustrates an example apparatus of the subject matter described herein.

FIG. 10 schematically illustrates an example apparatus 1000 of the subject matter described herein. FIG. 10 focuses on the functional components necessary for describing the operation of the apparatus.

The apparatus 1000 comprises a controller 1001. Implementation of the controller 1001 can be as controller circuitry. Implementation of the controller 1001 can be in hardware alone (for example processing circuitry comprising one or more processors and memory circuitry comprising one or more memory elements), have certain aspects in software including firmware alone or can be a combination of hardware and software (including firmware).

The controller can be implemented using instructions that enable hardware functionality, for example, by using executable computer program instructions in a general-purpose or special-purpose processor that can be stored on a computer readable storage medium (disk, memory etc.) or carried by a signal carrier to be performed by such a processor.

In the illustrated example, the apparatus 1000 comprises a controller 1001 which is provided by a processor 1002 and memory 1003. Although a single processor and a single memory are illustrated in other implementations there can be multiple processors and/or there can be multiple memories some or all of which can be integrated/removable and/or can provide permanent/semi-permanent/dynamic/cached storage.

The memory 1003 stores a computer program 1004 comprising computer program instructions 1005 that control the operation of the apparatus when loaded into the processor 1002. The computer program instructions provide the logic and routines that enable the apparatus to perform the methods presently described.

The computer program instructions 1005 are configured to cause the apparatus 1000 at least to perform the method described, for example with respect to FIGS. 4-9 discussed above and FIGS. 11-12 discussed below.

The processor 1002 is configured to read from and write to the memory 1003. The processor 1002 can also comprise an input interface 1006 via which data (e.g. first audio signal) and/or commands are input to the processor 1002 from one or more input devices 1008, and an output interface 1007 via which data (e.g. second and third audio signals) and/or commands are output by the processor 1002 to one or more output devices 1009. In some examples, the apparatus 1000 is housed in a device 1010 which comprises the one or more input devices (e.g. not least a wireless/wired data receiver and/or user input interface) and the one or more output devices (e.g. not least the headphones to render the second audio signal and a wireless/wired data transmitter to send the third audio signal to the loudspeakers for rendering therefrom). In such examples, the device may be a head mountable/wearable device such as a HMD, a VR/AR visor or smart glasses that may have built in headphones.

The apparatus 1000 comprises:

at least one processor 1002; and at least one memory 1003 including computer program instructions 1005 the at least one memory and the computer program instructions configured to, with the at least one processor, cause the apparatus at least to perform:

receiving a first audio signal representative of a virtual sound scene, wherein the first audio signal is configured for rendering on an arrangement of loudspeakers such that, when rendered on the arrangement of loudspeakers, the virtual sound scene is rendered to a user;

determining a first portion of the virtual sound scene to be rendered on headphones of the user;

generating a second audio signal representative of the first portion of the virtual sound scene, wherein the second audio signal is configured for rendering on the headphones;

determining a second portion of the virtual sound scene to be rendered on the arrangement of loudspeakers;

generating a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

The computer program can arrive at the apparatus 1000 via any suitable delivery mechanism 1011. The delivery mechanism 1011 can be, for example, a non-transitory computer-readable storage medium, a computer program product, a memory device, a record medium such as a compact disc read-only memory, or digital versatile disc, or an article of manufacture that tangibly embodies the computer program 1004. The delivery mechanism can be a signal configured to reliably transfer the computer program 1004.

The apparatus 1000 can receive, propagate or transmit the computer program 1004 as a computer data signal.

The apparatus 1000 can, for example, be a user equipment device, a client device, server device, a wearable device, a head mountable device, smart glasses, a wireless communications device, a portable device, a handheld device, etc. The apparatus can be embodied by a computing device, not least such as those mentioned above. However, in some examples, the apparatus can be embodied as a chip, chip set or module, i.e. for use in any of the foregoing.

Although examples of the apparatus have been described above in terms of comprising various components, it should be understood that the components can be embodied as or otherwise controlled by a corresponding controller or circuitry such as one or more processing elements or processors of the apparatus. In this regard, each of the components described above can be one or more of any device, means or circuitry embodied in hardware, software or a combination of hardware and software that is configured to perform the corresponding functions of the respective components as described above.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

In one example, the apparatus is embodied on a hand held portable electronic device, such as a mobile telephone, wearable computing device or personal digital assistant, that can additionally provide one or more audio/text/video communication functions (e.g. tele-communication, video-communication, and/or text transmission (Short Message Service (SMS)/Multimedia Message Service (MMS)/emailing) functions), interactive/non-interactive viewing functions (e.g. web-browsing, navigation, TV/program viewing functions), music recording/playing functions (e.g. Moving Picture Experts Group-1 Audio Layer 3 (MP3) or other format and/or (frequency modulation/amplitude modulation) radio broadcast recording/playing), downloading/sending of data functions, image capture function (e.g. using a (e.g. in-built) digital camera), and gaming functions.

The apparatus can be provided in a module. As used here 'module' refers to a unit or apparatus that excludes certain parts/components that would be added by an end manufacturer or a user.

Various, but not necessarily all, examples of the present disclosure provide both a method and corresponding apparatus comprising various modules, means or circuitry that provide the functionality for performing/applying the actions of the method. The modules, means or circuitry can be implemented as hardware, or can be implemented as software or firmware to be performed by a computer processor. In the case of firmware or software, examples of the present disclosure can be provided as a computer program product including a computer readable storage structure embodying computer program instructions (i.e. the software or firmware) thereon for performing by the computer processor.

The apparatus can be provided in an electronic device, for example, a mobile terminal, according to an exemplary embodiment of the present disclosure. It should be understood, however, that a mobile terminal is merely illustrative of an electronic device that would benefit from examples of implementations of the present disclosure and, therefore, should not be taken to limit the scope of the present disclosure to the same. While in certain implementation examples the apparatus can be provided in a mobile terminal, other types of electronic devices, such as, but not limited to, hand portable electronic devices, wearable computing devices, portable digital assistants (PDAs), pagers, mobile computers, desktop computers, televisions, gaming devices, laptop computers, cameras, video recorders, GPS devices and other types of electronic systems, can readily employ examples of the present disclosure. Furthermore, devices can readily employ examples of the present disclosure regardless of their intent to provide mobility.

The above described examples find application as enabling components of: automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

Where a structural feature has been described, it can be replaced by means for performing one or more of the functions of the structural feature whether that function or those functions are explicitly or implicitly described.

Figure 11:
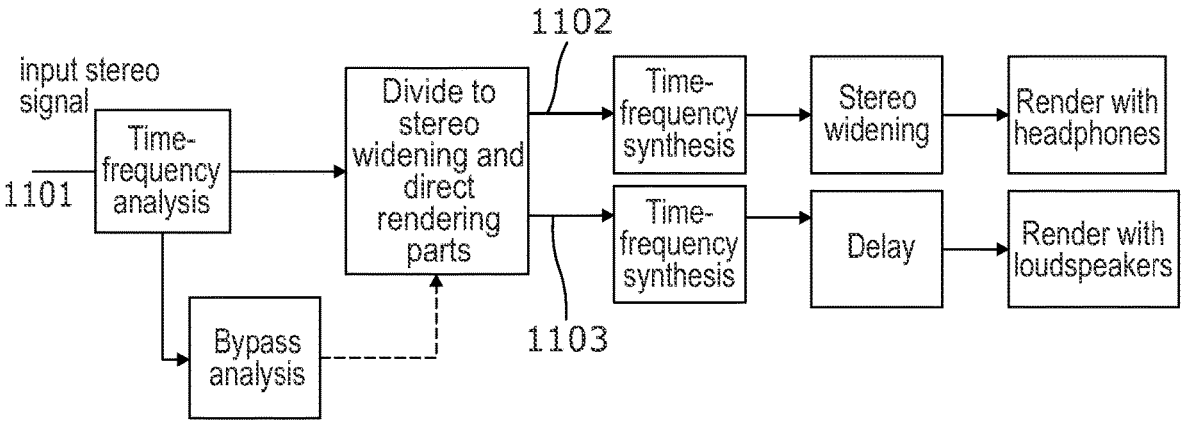
FIG. 11 schematically illustrates a yet further example method of the subject matter described herein.

FIG. 11 schematically illustrates a block diagram of an example of the audio signal processing that may occur in FIG. 6B. A first audio signal 1101 is received. This undergoes a time-frequency analysis, for example, with the short-time-fast-Fourier-transform. Next, a portion of the audio signal to be stereo widened is determined and analysed.

In this regard, in some examples, after the time-frequency analysis, the time-frequency domain audio signal is divided into frequency bands. For at least one band (typically all), a dominant direction is determined. The direction can be determined based on inspecting level (or energy) differences between the stereo signals in that band. For example, it can be assumed that a virtual sound object has been positioned using amplitude panning, and the dominant direction can be derived from the level differences based on the corresponding relative amplitude panning gains. This processing provides an estimate of the dominant direction for each frequency band. If the direction is such that it is difficult/impossible for a speaker setup being used to reproduce, then that frequency band may belong to the portion that is to be stereo widened. Otherwise, it may belong to the portion that is not to be stereo widened. Difficult/impossible directions typically are: for stereo speakers, any directions above +30 degrees or below −30 degrees where 0 degrees is "front" on a horizontal plane. For 5.1 setups, all directions that are far away from any physical speaker may be are difficult, i.e., around 180 degrees or around +/−70 degrees. Such processing provides coefficients for each frequency band whether the audio signal in it should go to the stereo widening or not. The coefficients may be "binary", i.e., 0 or 1, or they be any values between 0 and 1, providing smoother division between the portions (in that case, the audio signal in a frequency band may be partially forwarded to the stereo widening, and may be partially forwarded to bypass the stereo widening). In other examples, where the virtual sound objects are available as separate tracks with position (e.g. direction and location/distance) information, determining which virtual sound objects are to be stereo widened may comprise determining, using the virtual sound object's position information, whether the virtual sound object's location is greater than a threshold distance from a loudspeaker's location. In which case, such a virtual sound object may be selected for stereo widening, and virtual sound objects whose distance is within a threshold distance are not selected for stereo widening.

The portion of the audio signal that is to be stereo widened is divided out and extracted from the first audio signal and used to generate a second audio signal 1102. Likewise, the portion that is not to be stereo widened is also divided out and extracted from the first audio signal and used to generate a third audio signal 1103. These signals are then each passed for time-frequency synthesis which converts the signals back to the time domain. The second audio signal is processed to undergo stereo widening and is further processed for rendering on headphones. In this regard, it may undergo a head related transfer function and also optionally further processing so as to provide user perspective rendering of head tracked headphones. The third signal may have a delay applied thereto (so that it can be rendered/played back in temporal synchronization with the stereo widened second audio signal rendered on the headphones). Finally, the second and third signals are rendered from the headphones and loudspeakers respectively.

Figure 12:
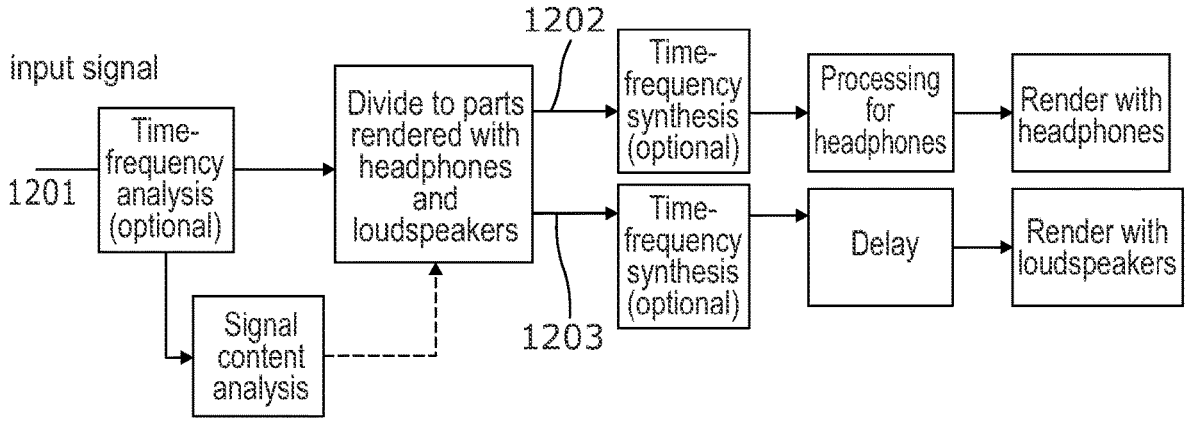
FIG. 12 schematically illustrates a yet further example method of the subject matter described herein.

FIG. 12 schematically illustrates a block diagram of an example of the signal processing that may occur in FIGS. 7B, 8B and 9B. A first audio signal 1201 is received, this undergoes an optional time-frequency analysis. The content of the signal is analysed. The signal content analysis can be, for example, analysis of the amount of low frequency content and high frequency content, or a determination of virtual sound objects having virtual positions virtually close to the user and virtual sound objects having virtual positions virtually far away from the user. Then, the first audio signal is divided into a second audio signal 1202 and a third audio signal 1203 based on the analysis; the second audio signal to be rendered from headphones and the third audio signal to be rendered from the loudspeakers. In the example of FIG. 7B, the first portion of the virtual sound scene represented by the second audio signal comprises close virtual sound objects and/or high frequency virtual sound objects; whilst the second portion of the virtual sound scene represented by the third audio signal comprises far away virtual sound objects, and/or low frequency virtual sound objects. In the example of FIG. 8B, the first portion of the virtual sound scene represented by the second audio signal comprises one or more virtual loudspeaker signals; whilst the second portion of the virtual sound scene represented by the third audio signal comprises the remaining loudspeaker signals. In the example of FIG. 9B, the first portion of the virtual sound scene represented by the second audio signal comprises one or more virtual speakers corresponding to a subset of the plurality of real loudspeaker signals to be reproduced from the virtual speakers via the headphones; whilst the second portion of the virtual sound scene represented by the third audio signal comprises all the plurality of loudspeaker signals to be rendered by the plurality of loudspeakers (i.e. so as to render virtual loudspeaker signals to supplement the physical loudspeaker signals). In the example of FIG. 9C, the first portion of the virtual sound scene represented by the second audio signal comprises one or more virtual speakers corresponding to a subset of the plurality of real loudspeaker signals to be reproduced from the virtual speakers via the headphones; whilst the second portion of the virtual sound scene represented by the third audio signal comprises the remainder of the plurality of loudspeaker signals to be rendered by the remainder of the plurality of loudspeakers (i.e. so as to render virtual loudspeaker signals to replace certain of the physical loudspeaker signals).

The second audio signal, divided out from the first audio signal, undergoes appropriate processing to enable rendering on the headphones, such as head-tracked head-related-transfer-function filtering. The third audio signal for rendering on the loudspeakers is delayed so that it temporally synchronizes with the headphone-rendered second audio signal.

In some embodiments, the distances of the user to the loudspeakers may be taken into account when determining the delay to be applied. In some examples, depending on the relative distances and arrangement of the loudspeakers relative to the user, the may be cases where the headphone-rendered portion is actually delayed instead of the loudspeaker-rendered portion.

Finally, the second and third signals are then rendered from the headphones and loudspeakers respectively.

Although specific terms are employed herein, they are used in a generic and descriptive sense only and not for purposes of limitation.

Features described in the preceding description can be used in combinations other than the combinations explicitly described.

Although functions have been described with reference to certain features, those functions can be performable by other features whether described or not. Although features have been described with reference to certain examples, those features can also be present in other examples whether described or not. Accordingly, features described in relation to one example/aspect of the disclosure can include any or all of the features described in relation to another example/aspect of the disclosure, and vice versa, to the extent that they are not mutually inconsistent. Although various examples of the present disclosure have been described in the preceding paragraphs, it should be appreciated that modifications to the examples given can be made without departing from the scope of the invention as set out in the claims.

The term 'comprise' is used in this document with an inclusive not an exclusive meaning. That is any reference to X comprising Y indicates that X can comprise only one Y or can comprise more than one Y. If it is intended to use 'comprise' with an exclusive meaning then it will be made clear in the context by referring to "comprising only one . . . " or by using "consisting".

As used herein, the term "determining" (and grammatical variants thereof) can include, not least: calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

In this description, reference has been made to various examples. The description of features or functions in relation to an example indicates that those features or functions are present in that example. The use of the term 'example' or 'for example', 'can' or 'may' in the text denotes, whether explicitly stated or not, that such features or functions are present in at least the described example, whether described as an example or not, and that they can be, but are not necessarily, present in some or all other examples. Thus 'example', 'for example', 'can' or 'may' refers to a particular instance in a class of examples. A property of the instance can be a property of only that instance or a property of the class or a property of a sub-class of the class that includes some but not all of the instances in the class.

In this description, references to "a/an/the" [feature, element, component, means . . . ] are to be interpreted as "at least one" [feature, element, component, means . . . ] unless explicitly stated otherwise. That is any reference to X comprising a/the Y indicates that X can comprise only one Y or can comprise more than one Y unless the context clearly indicates the contrary. If it is intended to use 'a' or 'the' with an exclusive meaning then it will be made clear in the context. In some circumstances the use of 'at least one' or 'one or more' can be used to emphasis an inclusive meaning but the absence of these terms should not be taken to infer and exclusive meaning.

The presence of a feature (or combination of features) in a claim is a reference to that feature (or combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

In the above description, the apparatus described can alternatively or in addition comprise an apparatus which in some other embodiments comprises a distributed system of apparatus, for example, a client/server apparatus system. In examples of embodiments where an apparatus provided forms (or a method is implemented as) a distributed system, each apparatus forming a component and/or part of the system provides (or implements) one or more features which collectively implement an example of the present disclosure. In some examples of embodiments, an apparatus is reconfigured by an entity other than its initial manufacturer to implement an example of the present disclosure by being provided with additional software, for example by a user downloading such software, which when executed causes the apparatus to implement an example of the present disclosure (such implementation being either entirely by the apparatus or as part of a system of apparatus as mentioned hereinabove).

The above description describes some examples of the present disclosure however those of ordinary skill in the art will be aware of possible alternative structures and method features which offer equivalent functionality to the specific examples of such structures and features described herein above and which for the sake of brevity and clarity have been omitted from the above description. Nonetheless, the above description should be read as implicitly including reference to such alternative structures and method features which provide equivalent functionality unless such alternative structures or method features are explicitly excluded in the above description of the examples of the present disclosure.

Whilst endeavouring in the foregoing specification to draw attention to those features of examples of the present disclosure believed to be of particular importance it should be understood that the applicant claims protection in respect of any patentable feature or combination of features hereinbefore referred to and/or shown in the drawings whether or not particular emphasis has been placed thereon.

The examples of the present disclosure and the accompanying claims can be suitably combined in any manner apparent to one of ordinary skill in the art.

Each and every claim is incorporated as further disclosure into the specification and the claims are embodiment(s) of the present invention. Further, while the claims herein are provided as comprising specific dependencies, it is contemplated that any claims can depend from any other claims and that to the extent that any alternative embodiments can result from combining, integrating, and/or omitting features of the various claims and/or changing dependencies of claims, any such alternative embodiments and their equivalents are also within the scope of the disclosure.

We claim:

1. An apparatus comprising:

at least one processor; and at least one non-transitory memory including computer program code, the at least one memory and the computer program code configured to, with the at least one processor, cause the apparatus to perform at least the following:

receive a first audio signal representative of a virtual sound scene, wherein the first audio signal is configured for rendering on an arrangement of loudspeakers such that, when rendered on the arrangement of loudspeakers, the virtual sound scene is rendered to a user;

determine a first portion of the virtual sound scene to be rendered on headphones of the user, wherein the first portion is determined based, at least partially, on the arrangement of loudspeakers;

generate a second audio signal representative of the first portion of the virtual sound scene, wherein the second audio signal is configured for rendering on the headphones;

determine a second portion of the virtual sound scene to be rendered on the arrangement of loudspeakers;

generate a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

2. The apparatus of claim 1, wherein the virtual sound scene comprises a first virtual sound object having a first virtual position, wherein the determined first portion comprises the first virtual sound object, and wherein the apparatus is configured to:

generate the second audio signal so as to control the virtual position of the first virtual sound object of the first portion of the virtual sound scene represented by the second audio signal such that, when the second audio signal is rendered on the headphones, the first virtual sound object is rendered to the user at a second virtual position.

3. The apparatus of claim 2, wherein the second audio signal is generated such that, when rendered on the headphones, a modified version of the first portion is rendered to the user.

4. The apparatus of claim 2, wherein the second virtual position is different to the first virtual position.

5. The apparatus of claim 2, wherein the determining the first portion of the virtual sound scene to be rendered on the headphones comprises determining one or more virtual sound objects to be stereo widened are located in the first portion of the virtual sound scene.

6. The apparatus of claim 2, wherein the determining the first portion of the virtual sound scene to be rendered on the headphones comprises determining one or more virtual sound objects whose virtual distance is less than a threshold virtual distance.

7. The apparatus of claim 2, wherein the second virtual position is the same as the first virtual position.

8. The apparatus of claim 1, wherein the apparatus is configured to generate the second and third audio signals such that, when the second and third signals are simultaneously rendered on the headphones and the arrangement of loudspeakers respectively, they are perceived by the user to be in temporal synchronisation.

9. The apparatus of claim 1, wherein the apparatus further caused to cause:

the second audio signal to be conveyed to the headphones for rendering therefrom; and the third audio signal to be conveyed to the arrangement of loudspeakers for rendering therefrom.

10. The apparatus of claim 1, wherein the apparatus is configured to transform the second audio signal for spatial audio rendering on the headphones, wherein the first portion of the virtual sound scene is configured to include at least one of wideband sounds or low frequency portions of one or more virtual sound objects of the virtual sound scene, wherein the second portion of the virtual sound scene is configured to include at least one of high frequency sounds or high frequency portions of the one or more virtual sound objects of the virtual sound scene.

11. The apparatus of claim 1, wherein the position of the headphones is tracked and the generating or rendering of the second audio signal is modified based on the tracked position.

12. The apparatus of claim 1, wherein one or more of the audio signals is: a spatial audio signal or a multichannel audio signal.

13. A method comprising:

receiving a first audio signal representative of a virtual sound scene, wherein the first audio signal is configured for rendering on an arrangement of loudspeakers such that, when rendered on the arrangement of loudspeakers, the virtual sound scene is rendered to a user;

determining a first portion of the virtual sound scene to be rendered on headphones of the user, wherein the first portion is determined based, at least partially, on the arrangement of loudspeakers;

generating a second audio signal representative of the first portion of the virtual sound scene, wherein the second audio signal is configured for rendering on the headphones;

determining a second portion of the virtual sound scene to be rendered on the arrangement of loudspeakers;

generating a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

14. The method of claim 13, wherein the virtual sound scene comprises a first virtual sound object having a first virtual position, wherein the determined first portion comprises the first virtual sound object, and wherein the method further comprises:

generating the second audio signal so as to control the virtual position of the first virtual sound object of the first portion of the virtual sound scene represented by the second audio signal such that, when the second audio signal is rendered on the headphones, the first virtual sound object is rendered to the user at a second virtual position.

15. The method of claim 14, wherein the second audio signal is generated such that, when rendered on the headphones, a modified version of the first portion is rendered to the user.

16. The method of claim 14, wherein the second virtual position is different to the first virtual position.

17. The method of claim 14, wherein the determining the first portion of the virtual sound scene to be rendered on the headphones comprises determining one or more virtual sound objects to be stereo widened.

18. The method of claim 14, wherein the determining the first portion of the virtual sound scene to be rendered on the headphones comprises determining one or more virtual sound objects whose virtual distance is less than a threshold virtual distance.

19. The method of claim 14, wherein the second virtual position is the same as the first virtual position.

20. A non-transitory computer readable medium comprising program instructions stored thereon for performing at least the following:

receiving a first audio signal representative of a virtual sound scene, wherein the first audio signal is configured for rendering on an arrangement of loudspeakers such that, when rendered on the arrangement of loudspeakers, the virtual sound scene is rendered to a user;

determining a first portion of the virtual sound scene to be rendered on headphones of the user, wherein the first portion is determined based, at least partially, on the arrangement of loudspeakers;

generating a second audio signal representative of the first portion of the virtual sound scene, wherein the second audio signal is configured for rendering on the headphones;

determining a second portion of the virtual sound scene to be rendered on the arrangement of loudspeakers;

generating a third audio signal, representative of the second portion of the virtual sound scene, wherein the third audio signal is configured for rendering on the arrangement of loudspeakers; and wherein the second and third audio signals are generated such that, when rendered on the headphones and the arrangement of loudspeakers respectively, an augmented version of the virtual sound scene is rendered to the user.

* * * * *